US009342010B2

(12) United States Patent
Shimura et al.

(10) Patent No.: US 9,342,010 B2
(45) Date of Patent: May 17, 2016

(54) IMAGE HEATING APPARATUS

(71) Applicant: CANON KABUSHIKI KAISHA, Tokyo (JP)

(72) Inventors: Yasuhiro Shimura, Yokohama (JP); Hideaki Yonekubo, Suntou-gun (JP); Hisashi Nakahara, Numazu (JP); Akira Kato, Mishima (JP); Noriaki Tanaka, Suntou-gun (JP); Hideyuki Matsubara, Mishima (JP); Yuji Fujiwara, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/541,583

(22) Filed: Nov. 14, 2014

(65) Prior Publication Data

US 2015/0139708 A1 May 21, 2015

(30) Foreign Application Priority Data

Nov. 18, 2013 (JP) ..... 2013-237909
Nov. 18, 2013 (JP) ..... 2013-237913
Sep. 29, 2014 (JP) ..... 2014-198446

(51) Int. Cl.
*G03G 15/20* (2006.01)

(52) U.S. Cl.
CPC ..... *G03G 15/206* (2013.01); *G03G 15/2042* (2013.01); *G03G 15/2053* (2013.01); *G03G 2215/2016* (2013.01); *G03G 2215/2035* (2013.01)

(58) Field of Classification Search
CPC ..... G03G 15/206; G03G 15/2053
See application file for complete search history.

(56) References Cited

U.S. PATENT DOCUMENTS 7,193,181 B2 3/2007 Makihira et al.
7,203,438 B2 4/2007 Omata et al.
7,283,145 B2 10/2007 Kato et al.
7,366,455 B2 4/2008 Iwasaki et al.
7,630,662 B2 12/2009 Namiki et al.

(Continued)

FOREIGN PATENT DOCUMENTS

JP 10-144453 A 5/1998
JP 11-84919 * 3/1999

(Continued)

OTHER PUBLICATIONS

U.S. Appl. No. 14/539,262, filed Nov. 12, 2014.

(Continued)

*Primary Examiner* — Sandra Brase
(74) *Attorney, Agent, or Firm* — Fitzpatrick, Cella, Harper & Scinto

(57) ABSTRACT

An image heating apparatus includes: a heater including a substrate and a heat generating element; a supporting member; and a high heat-conductive member. The recording material on which an image is formed is heated by heat from the heater. The supporting member has a bottom region, where the supporting member supports the heater, including a first region where the supporting member contacts the high heat-conductive member so as to apply pressure between the heater and the high heat-conductive member and including a second region where the supporting member is recessed from the high heat-conductive member relative to the first region. At least a part of the first region overlaps, with respect to a movement direction of the recording material, with a region where the heat generating element is provided.

21 Claims, 25 Drawing Sheets

(56) References Cited

U.S. PATENT DOCUMENTS

| | | | | |
|---|---|---|---|---|
| 7,650,105 | B2 | 1/2010 | Ogawa et al. | |
| 7,734,241 | B2 | 6/2010 | Nishida et al. | |
| 8,494,383 | B2 | 7/2013 | Shimura et al. | |
| 8,532,554 | B2 | 9/2013 | Uchiyama et al. | |
| 8,606,136 | B2 | 12/2013 | Shimura et al. | |
| 8,642,927 | B2 | 2/2014 | Shimura | |
| 8,653,422 | B2 | 2/2014 | Shimura et al. | |
| 8,698,046 | B2 | 4/2014 | Shimura et al. | |
| 8,755,705 | B2 | 6/2014 | Nakahara et al. | |
| 8,818,214 | B2 | 8/2014 | Shimura | |
| 8,859,940 | B2 | 10/2014 | Shimrua | |
| 8,884,192 | B2 | 11/2014 | Shimura | |
| 2006/0045589 | A1 | 3/2006 | Iwasaki et al. | |
| 2011/0123238 | A1* | 5/2011 | Kimura | 399/320 |
| 2012/0020709 | A1 | 1/2012 | Uchiyama et al. | |
| 2012/0308252 | A1 | 12/2012 | Shimura | |
| 2013/0164057 | A1 | 6/2013 | Endo et al. | |
| 2013/0266333 | A1 | 10/2013 | Fujiwara | |
| 2013/0266334 | A1 | 10/2013 | Shimura et al. | |
| 2014/0169811 | A1 | 6/2014 | Shimura | |
| 2014/0169846 | A1 | 6/2014 | Shimura et al. | |
| 2014/0308051 | A1 | 10/2014 | Shimura | |

FOREIGN PATENT DOCUMENTS

| | | | |
|---|---|---|---|
| JP | H1184949 | A | 3/1999 |
| JP | 2002-50452 | A | 2/2002 |
| JP | 2003007435 | A | 1/2003 |
| JP | 2003-317898 | A | 11/2003 |
| JP | 2011-018027 | A | 1/2011 |

OTHER PUBLICATIONS

European Search Report issued in counterpart European Patent Application No. 14193379.6-1560, dated Mar. 24, 2015.

* cited by examiner

IMAGE HEATING APPARATUS

FIELD OF THE INVENTION AND RELATED ART

The present invention relates to an image heating apparatus suitable for use as a fixing device (apparatus) to be mounted in an image forming apparatus such as an electrophotographic copying machine or an electrophotographic printer, and relates to the image forming apparatus in which the image heating apparatus is mounted.

In an image forming apparatus in which the image heating apparatus is mounted, when continuous printing is performed using a small-sized recording material having a width smaller than a maximum-width recording material (sheet) usable in the image heating apparatus, a non-sheet-passing portion temperature rise is generated. This is a phenomenon in which the temperature rises in a region (non-sheet-passing portion) through which the small-sized sheet passes with respect to a longitudinal direction of a fixing nip.

As one of methods for suppressing this non-sheet-passing portion temperature rise, in Japanese Laid-Open Patent Application (JP-A) 2003-317898, a method has been proposed in which a high heat-conductive member having a high thermal conductivity is sandwiched between a heater supporting member and a ceramic heater.

It turned out that the time until the temperature of the image heating apparatus reaches a predetermined temperature and the a response time of a protecting function in the case where the heater cannot be controlled vary, depending on the structure in which the high heat-conductive member is sandwiched.

SUMMARY OF THE INVENTION

A principal object of the present invention is to provide an image heating apparatus having a short rise time and high reliability, while having a function of suppressing the temperature rise at a non-sheet-passing portion.

According to an aspect of the present invention, there is provided an image heating apparatus comprising: a heater including a substrate and a heat generating element provided on the substrate; a supporting member for supporting the heater; and a high heat-conductive member sandwiched between the heater and the supporting member. A recording material on which an image is formed is heated by heat from the heater. The supporting member has a bottom region, where the supporting member supports the heater, including a first region where the supporting member contacts the high heat-conductive member so as to apply pressure between the heater and the high heat-conductive member and a second region where the supporting member is recessed from the high heat-conductive member relative to the first region. At least a part of the first region overlaps, with respect to a movement direction of the recording material, with a region where the heat generating element is provided.

According to another aspect of the present invention, there is provided an image heating apparatus comprising: a cylindrical film; a heater including a substrate and a heat generating element provided on the substrate, the heater contacting an inner surface of the film; a supporting member for supporting the heater; and a high heat-conductive member sandwiched between the heater and the supporting member. A recording material on which an image is formed is heated by heat from the heater via the film. The supporting member has a bottom region, where the supporting member supports the heater, including a first region where the supporting member contacts the high heat-conductive member so as to apply pressure between the heater and the high heat-conductive member and including a second region where the supporting member is recessed from the high heat-conductive member relative to the first region. With respect to a movement direction of the recording material, the first region is provided in at least two positions including a first position corresponding to a downstreammost position of a contact region between the film and the heater and a second position upstream of the first position corresponding to the downstreammost position of the contact region. At least a part of the second region is provided between the first position and the second position.

These and other objects, features and advantages of the present invention will become more apparent upon a consideration of the following description of the preferred embodiments of the present invention taken in conjunction with the accompanying drawings.

DESCRIPTION OF THE EMBODIMENTS

Embodiment 1

(1) Image Forming Apparatus

Figure 1:
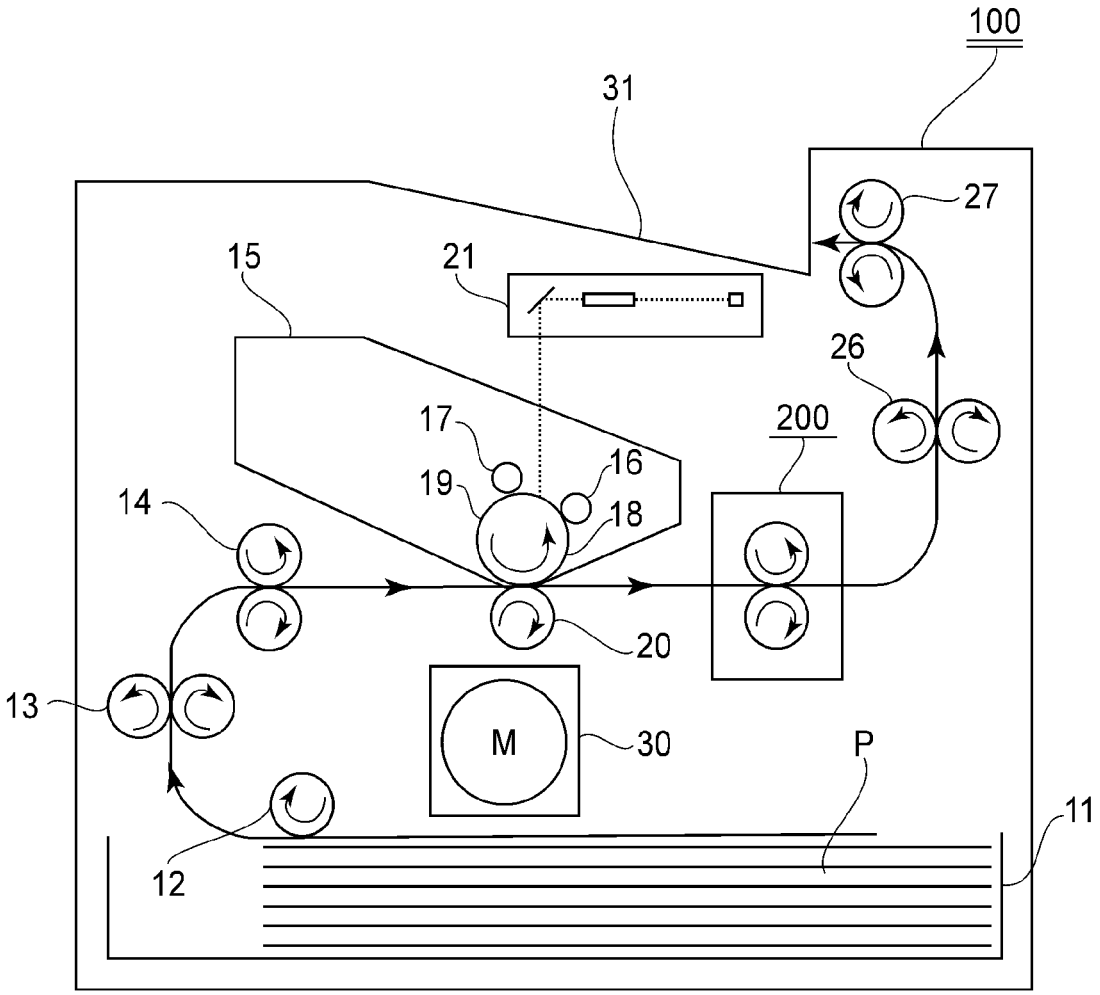
FIG. 1 is a schematic illustration of an image forming apparatus in Embodiment 1.

FIG. 1 is a schematic cross-sectional view of an example of an image forming apparatus 100 in which an image heating apparatus according to the present invention is mounted as a fixing device 200. This image forming apparatus 100 is a laser printer using electrophotographic recording technology, and forms an image, on a sheet (sheet-like recording material) P, corresponding to electrical image information inputted from a host device 500 (FIG. 6) such as a personal computer into a controller 101, and then prints outs the sheet.

When a print signal is generated, a scanner unit 21 emits laser light modulated depending on the image information, and scans a photosensitive member 19, which is electrically charged to a predetermined polarity by a charging roller 16 and which is rotationally driven in the counterclockwise direction indicated by an arrow. As a result, an electrostatic latent image is formed on the photosensitive member 19. To this electrostatic latent image, a toner (developer) is supplied from a developing device 17, so that a toner image depending on the image information is formed on the photosensitive member 19. On the other hand, the sheets P stacked in a sheet-feeding cassette 11 are fed one by one by a pick-up roller 12, and then are fed toward a registration roller pair 14 by a roller pair 13.

Then, the sheet P is fed to a transfer position from the registration roller pair 14 in synchronism with the timing when the toner image on the photosensitive member 19 reaches the transfer position formed between the photosensitive member 19 and a transfer roller 20. In a process in which the sheet P passes through the transfer position, the toner image is transferred from the photosensitive member 19 onto the sheet P. Therefore, the sheet P is heated by the fixing device 200, so that the toner image is heat-fixed on the sheet P. The sheet P carrying thereon the fixed toner image is discharged onto a tray 31 at an upper portion by roller pairs 26 and 27.

The image forming apparatus 100 includes a cleaner 18 for cleaning the photosensitive member 19 and a motor 30 for driving the fixing device 200 and the like. The photosensitive member 19, the charging roller 16, the scanner unit 21, the developing device 17, the transfer roller 20, and the like, which are described above, constitute an image forming portion. The photosensitive member 19, the charging roller 16, the developing device 17 and the cleaner 18 are constituted as a process cartridge 15 detachably mountable to a main assembly of the printer in a collective manner. An operation and image forming process of the above-described image forming portion are well known and therefore a detailed description thereof will be omitted.

The laser printer 100 in this embodiment uses a plurality of sheet sizes. That is, the laser printer 100 is capable of printing the image on sheets having the plurality of sheet sizes, including a letter paper size (about 216 mm×279 mm), an A4 paper size (210 mm×297 mm) and A5 paper size (148 mm×210 mm).

The printer basically feeds the sheet in a short edge feeding manner (in which a long edge of the sheet is parallel to a (sheet) feeding direction) by center-line basis feeding, and the largest size (in width) of compatible regular sheet sizes (listed in a catalogue) is about 216 mm in width of the letter paper. This sheet having the largest width size is defined as a large-sized paper (sheet). Sheets (A4-sized paper, A5-sized paper and the like) having paper widths smaller than this sheet are defined as a small-sized paper.

The center-line basis feeding of the sheet P is such that even when any large and small (width) sheets capable of being passed through the printer are used, each of the sheets is passed through the printer in a manner in which a center line of the sheet with respect to a widthwise direction is aligned with a center (line) of a sheet feeding path with respect to the widthwise direction.

(2) Fixing Device (Image Heating Apparatus)

(2-1) Brief Description of Device Structure

Figure 2:
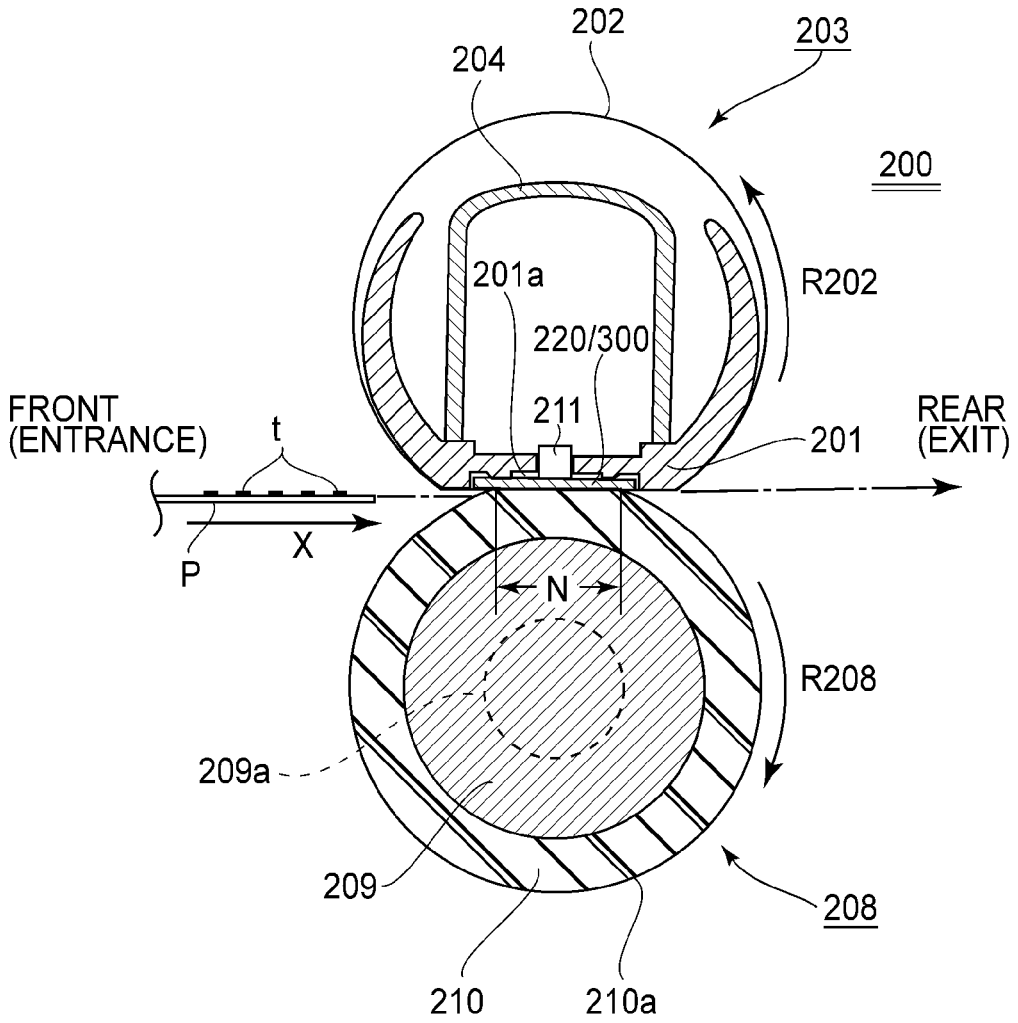
FIG. 2 is a schematic cross-sectional view of a principal part of a fixing device (image heating apparatus).
Figure 3:
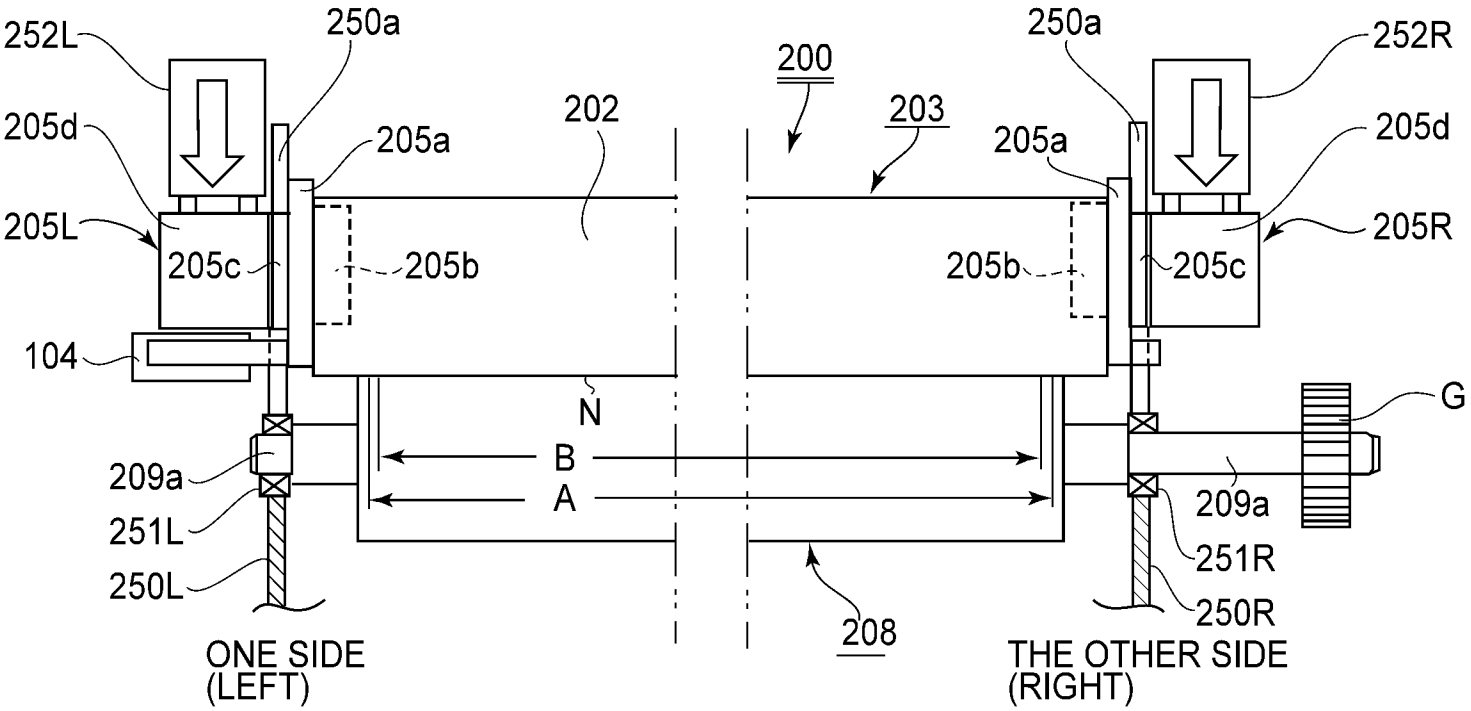
FIG. 3 is a schematic first view of the principal part of the fixing device which is partly omitted in midstream.
Figure 4:
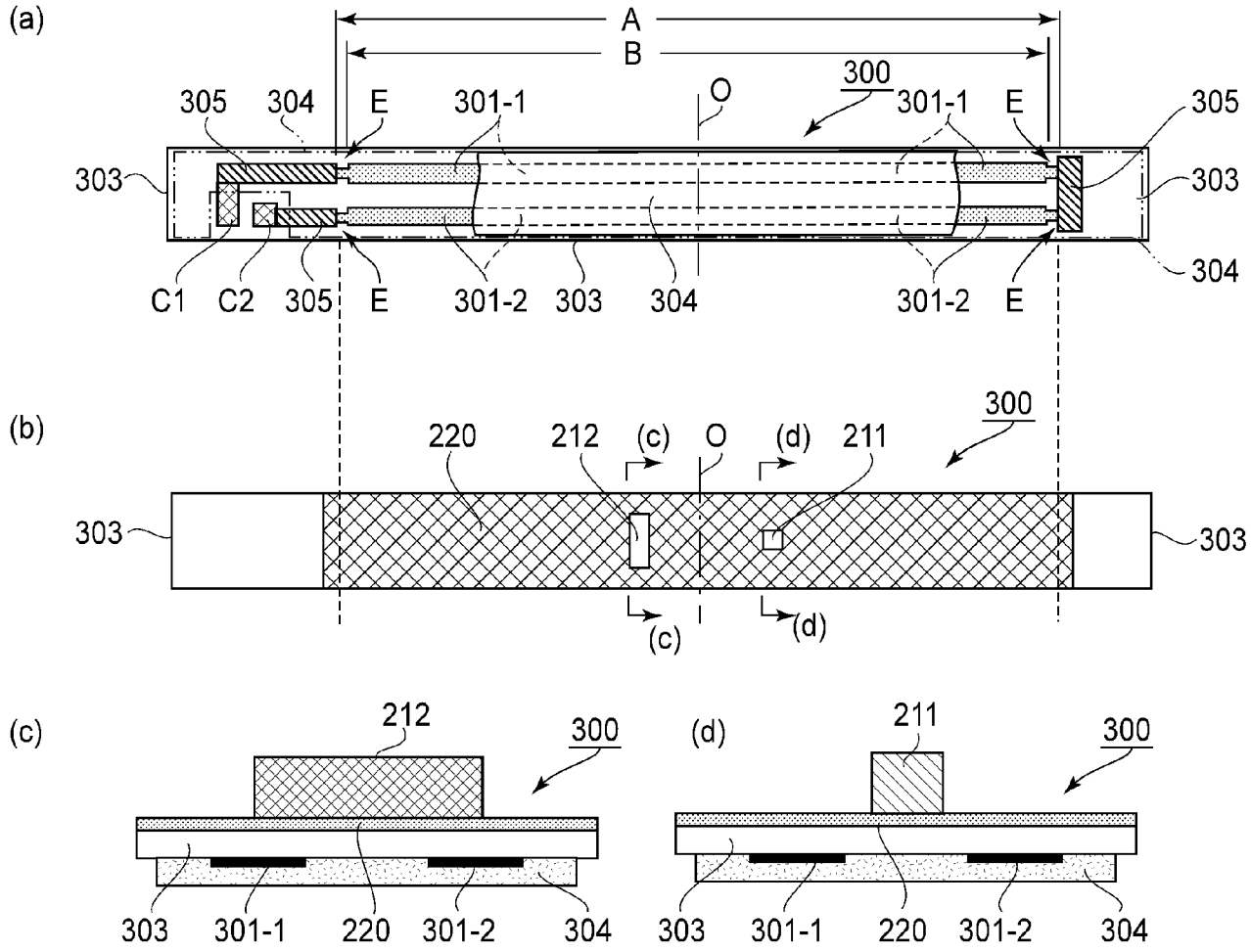
In FIG. 4, (a) to (d) are illustrations of a structure of a heater (heat generating element).
Figure 5:
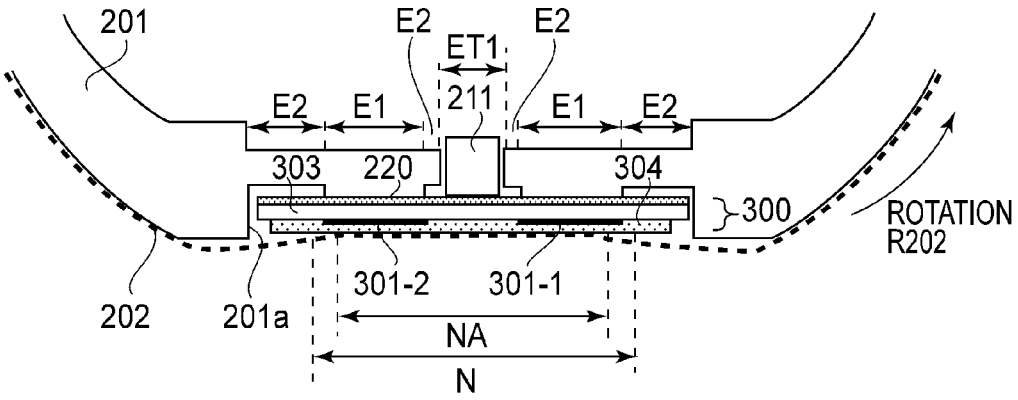
FIG. 5 is a partly enlarged view of FIG. 2.
Figure 6:
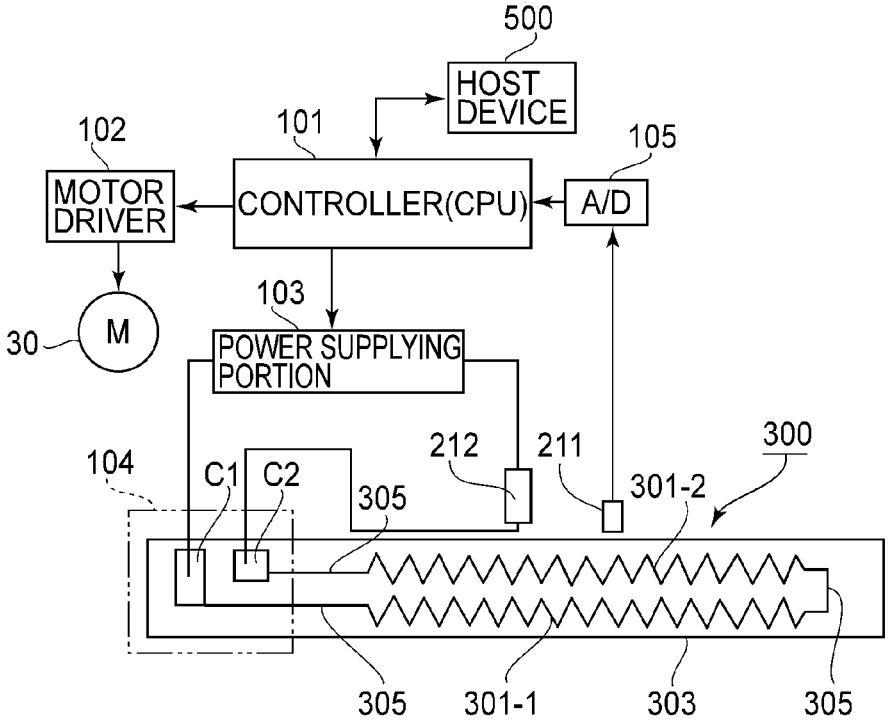
FIG. 6 is a block diagram of a control system.

FIG. 2 is a schematic cross-sectional view of a principal part of a fixing device 200 in this embodiment. FIG. 3 is a schematic first view of the principal part of the fixing device 200 which is partly omitted in midstream. In FIG. 4, (a) to (d) are illustrations of a structure of a heater (heat generating element). FIG. 5 is a partly enlarged view of FIG. 2. FIG. 6 is a block diagram of a control system.

With respect to the fixing device 200 and constituent elements thereof in this embodiment, a front side (surface) is a side (surface) when the fixing device 200 is seen from a sheet entrance side thereof, and a rear side (surface) is a side (surface) (sheet exit side) opposite from the front side. Left and right are left (one end side) and right (the other end side) when the fixing device 200 is seen from the front side. Further, an upstream (side) and a downstream (side) are those with respect to a sheet feeding direction X.

A longitudinal direction (widthwise direction) and a sheet width direction of the fixing device are directions substantially parallel to a direction perpendicular to the feeding direction X of the sheet P (or a movement direction (movable member movement direction) of a film which is a movable member). A short direction of the fixing device is a direction substantially parallel to the feeding direction X of the sheet P (or the movement direction of the film).

The fixing device 200 in this embodiment is an on-demand fixing device of a film (belt) heating type and a tension-less type. The fixing device 200 roughly includes a film unit 203 including a flexible cylindrical (endless) film (belt) 202 as the movable member, and includes a pressing roller (elastic roller: rotatable pressing member) 208, having a heat-resistant property and elasticity, as a nip-forming member.

The film unit 203 is an assembly of a heater 300 as a heating member, a high heat-conductive member 220, a heater supporting member 201, a pressing stay 204, regulating members (flanges) 205 (L, R) for regulating shift (lateral deviation) of the film 202, and the like.

The film 202 is a member for conducting method to the sheet P, and has a composite structure consisting of a cylindrical base layer (base material layer), an elastic layer formed on an outer peripheral surface of the base layer, a parting layer as a surface layer formed on an outer peripheral surface of the elastic layer, and an inner surface coating layer formed on an inner peripheral surface of the base layer. A material for the base layer is a heat-resistant resin such as polyimide or metal such as stainless steel.

Each of the heater 300, the high heat-conductive member 220, the heater supporting member 201 and the pressing stay 204 is a long member extending in a left-right direction of the fixing device. The film 202 is externally fitted loosely onto an assembly of the stay 204 and the heater supporting member 201 on which the heater 300 and the high heat-conductive member 220 are supported. The regulating members 205 (L, R) are mounted on one end portion and the other end portion of the pressing stay 204 in one end side and the other end side of the film 202, so that the film 202 is interposed between the left and right regulating members 205L and 205R.

The heater 300 is a ceramic heater in this embodiment. The heater 300 has a basic structure including a ceramic substrate having an elongated thin plate shape and a heat generating element (heat generating resistor) which is provided on a surface of this substrate in one side of the substrate and which generates heat by energization (supply of electric power) to the heat generating element, and is a low-thermal-capacity heater increased in temperature with an abrupt rising characteristic by the energization to the heat generating element. A specific structure of the heater 300 will be described in (3) below in detail.

The heater supporting member 201 is a molded member formed of the heat-resistant resin, and is provided with a heater-fitting groove 201*a* along a longitudinal direction of the member at a substantially central portion with respect to a circumferential direction of the outer surface of the member. The high heat-conductive member 220 and the heater 300 are fitted (engaged) into and supported by the heater-fitting groove 201*a*. In the groove 201*a*, the high heat-conductive member 220 is interposed between the heater supporting member 201 and the heater 300. The high heat-conductive member 220 will be described in (3) specifically.

The heater supporting member 201 not only supports the high heat-conductive member 220 and the heater 300 but also functions as a guiding member for guiding rotation of the film 202 externally fitted onto the heater supporting member 201 and the pressing stay 204.

The pressing stay 204 is a member having rigidity, and is a member for providing a longitudinal strength to the heater supporting member 201 by being pressed against an inside (back side) of the resin-made heater supporting member 201 and for rectifying the heater supporting member 201. In this embodiment, the pressing stay 204 is a metal-molded material having an U-shape in cross section.

Each of the regulating members 205 (L, R) a molded member formed of the heat-resistant resin so that the regulating members 205 (L, R) have a bilaterally symmetrical shape, and has the functions of regulating (limiting) movement (thrust movement) along the longitudinal direction of the heater supporting member 201 during the rotation of the film 202 and of guiding an inner peripheral surface of a film end portion during the rotation of the film 202. That is, each of the regulating members 205 (L, R) includes a flange portion 205*a*, for receiving (stopping) the film end surface, as a first regulating (limiting) portion for regulating the thrust movement of the film 202. Further, each of the regulating members 205 (L, R) includes an inner surface guiding portion 205*b* as a second regulating portion for guiding an inner surface of the film end portion by being fitted into the film end portion.

The pressing roller 208 is an elastic roller having a composite layer structure including a metal core 209 formed of a material such as iron or aluminum, an elastic layer 210 formed, of a material such as a silicone rubber, around the metal core in a roller shape, and a parting layer (surface layer) 210*a* coating an outer peripheral surface of the elastic layer 210.

The pressing roller 208 is provided so that each of rotation center shaft portions 209*a* in left and right end portion sides is rotatably supported in the associated one of left and right side plates 250 (L, R) of a fixing device frame via the associated one of bearing members (bearings) 251 (L, R). The right-side shaft portion 209*a* is provided concentrically integral with a drive gear G. To this drive gear G, a driving force of the motor 30 controlled by a controller 101 via a motor driver 102 is transmitted via a power transmitting mechanism (not shown). As a result, the pressing roller 208 is rotationally driven as a rotatable driving member at a predetermined peripheral speed in the clockwise direction of an arrow R208 in FIG. 2.

On the other hand, the film unit 203 is disposed on and in substantially parallel with the pressing roller 208 while keeping a heater-disposed portion side of the heater supporting member 201 downward, and is disposed between the left and right side plates 250 (L, R). Specifically, a vertical guiding groove 205*c* provided in each of the left and right regulating members 250 (L, R) of the film unit 203 engages with an associated vertical guiding slit 250*a* provided in each of the left and right side plates 250 (L, R).

As a result, the left and right regulating members 205 (L, R) are supported by the left and right side plates 250 (L, R), respectively, so as to be vertically slidable (movable) relative to the left and right side plates 250 (L, R), respectively. That is, the film unit 203 is supported by and vertically slidable relative to the left and right side plates 250 (L, R). The heater-disposed portion of the heater supporting member 201 of the film unit 203 opposes the pressing roller 208 via the film 202.

Further, pressure-receiving portions 205*d* of the left and right regulating members 205 (L, R) are pressed at a predetermined pressing force (pressure) by left and right pressing mechanisms 252 (L, R), respectively. Each of the left and right pressing mechanisms (L, R) 252 is a mechanism including, e.g., a pressing spring, a pressing lever or a pressing cam. That is, the film unit 203 is pressed against the pressing roller 208 at the predetermined pressing force, so that the film 202 on the heater-disposed portion of the heater supporting member 201 is press-contacted to the pressing roller 208 against elasticity of the elastic (material) layer 210 of the pressing roller 208.

As a result, the heater 300 contacts the inner surface of the film 202, so that a nip N having a predetermined width with respect to a film movement direction (movable member movement direction) is formed between the film 202 and the pressing roller 208. That is, the pressing roller 208 forms the nip N via the film 202 in combination with the heater 300.

The heater 300 exists on the heater supporting member 201 at a position corresponding to the nip N and extends in the longitudinal direction of the heater supporting member 201. In the fixing device 200 in this embodiment, the heater 300 and the heater supporting member 201 constitute a back-up member contacting the inner surface of the film 202. Further, the pressing roller 208 forms the nip N via the film 202 in combination with the back-up member (300, 201). In this way, the heater 300 is provided inside the film 202, and is press-contacted to the film 202 toward the pressing roller 208 to form the nip N.

(2-2) Fixing Operation

A fixing operation of the fixing device 200 is as follows. The controller 101 actuates the motor 30 at predetermined control timing. From this motor 30 to the pressing roller 208, a rotational driving force is transmitted. As a result, the pressing roller 208 is rotationally driven at a predetermined speed in the clockwise direction of the arrow R208.

The pressing roller 208 is rotationally driven, so that at the nip N, a rotational torque acts on the film 202 by a frictional force with the film 202. As a result, the film 202 is rotated, by the rotation of the pressing roller 208, in the counterclockwise direction of an arrow R202 around the heater supporting member 201 and the pressing stay 204 at a speed substantially corresponding to the speed of the pressing roller 208 while being slid in close contact with the surface of the heater 300 at the inner surface thereof. Onto the inner surface of the film 202, a semisolid lubrication is applied, thus ensuring a sliding property between the outer surface of each of the heater 300 and the heater supporting member 201 and the inner surface of the film 202 in the nip N.

Further, the controller starts energization (supply of electric power) from a power supplying portion (power controller) 103 to the heater 300. The power supply from the power supplying portion 103 to the heater 300 is made is made via an electric connector 104 mounted in a left end portion side of the film unit 203. By this energization, the heater 300 is quickly increased in temperature.

The temperature increase (rise) is detected by a thermistor (temperature detecting element) 211 provided in contact with the high heat-conductive member 220 contacting the back surface (upper surface) of the heater 300. The thermistor 211 is connected with the controller 101 via an A/D converter 105. The film 202 is heated at the nip N by heat generation of the heater 300 by the energization.

The controller 101 samples an output from the thermistor 211 at a predetermined period, and the thus-obtained temperature information is reflected in temperature control. That is, the controller 101 determines the contents of the temperature control of the heater 300 on the basis of the output of the thermistor 211, and controls the energization to the heater 300 by the power supplying portion 103 so that a temperature of the heater 300 at a portion corresponding to the sheet-passing portion is a target temperature (predetermined set temperature).

In a control state of the fixing device 200 described above, the sheet P on which an unfixed toner image t is carried is fed from the image forming portion toward the fixing device 200, and then is introduced into the nip N. The sheet P is supplied with heat from the heater 300 via the film 202 in a process in which the sheet P is nipped and fed through the nip N. The toner image t is melt-fixed as a fixed image on the surface of the sheet P by the heat of the heater 300 and the pressure at the nip N. That is, the toner image on the sheet (recording material) is heated and fixed. The sheet P coming out of the nip N is curvature-separated from the film 202 and is discharged from the device 200, and then is fed.

The controller 101 stops, when the printing operation is ended, the energization from the power supplying portion 103 to the heater 300 by an instruction to end the fixing operation. Further, the controller stops the motor 30.

In FIG. 3, A is a maximum heat generation region width of the heater 300. B is a sheet-passing width (maximum sheet-passing width) of the large-sized paper, and is a width equal to or somewhat smaller than the maximum heat generation region width A. In this embodiment, the maximum sheet-passing width B is about 216 mm (short edge feeding) of the letter paper. A full length of the nip N formed by the film 202 and the pressing roller 208 (i.e., a length of the pressing roller 208) is a width larger than the maximum heat generation region width A of the heater 300.

(3) Heater 300

In FIG. 4, (a) is a schematic plan view of the heater 300 which is partly cut away in one surface side (front surface side), (b) is a schematic plan view of the heater 300 in the other surface side (back surface side), (c) is a sectional view at (c)-(c) position in (b) of FIG. 4, and (d) is a sectional view at (d)-(d) position in (b) of FIG. 4.

The heater 300 as the heating member in this embodiment includes a substrate 303 and heat generating elements 301-1 and 301-2. Each of the heat generating elements is a heat generating element provided on the substrate along the longitudinal direction of the substrate, and the heat generating elements includes a plurality of the heat generating elements 301-1 and 301-2 which are first and second heat generating elements provided at different positions with respect to a short direction of the substrate while extending along the longitudinal direction of the substrate.

In this embodiment, the heater 300 is the ceramic heater. Basically, the heater 300 includes a heater substrate 303 formed by ceramic in an elongated thin plate shape, and first and second (two) heat generating resistors 301-1 and 301-2 provided along the longitudinal direction of the substrate in one surface side (front surface side) of the heater substrate 303. The heater 300 further includes an insulating (surface) protecting layer 304 which covers the heat generating resistors.

The heater surface 303 is a ceramic substrate, formed of, e.g., $Al_2O_3$ or AlN in an elongated thin plate shape, extending in a longitudinal direction crossing with (perpendicular to) a sheet-passing direction at the nip N. Each of the heat generating resistors 301-1 and 301-2 is formed by pattern-coating an electric resistance material paste of, e.g., Ag/Pd (silver/palladium) by screen printing and then by baking the paste. In this embodiment, the heat generating resistors 301-1 and 301-2 are formed in strip shape, and the two heat generating resistors are formed in parallel with each other along the longitudinal direction of the substrate with a predetermined interval therebetween on the substrate surface with respect to the short direction of the substrate.

In one end side (left side) of the heat generating resistors 301-1 and 301-2, the heat generating resistors are electrically connected to electrode portions (contact portions) C1 and C2, respectively, via electroconductive members 305. Further, in the other end side (right side) of the heat generating resistors 301-1 and 301-2, the heat generating resistors are electrically connected in series by an electroconductive member 305. Each of the electroconductive members 305 and the electrode portions C1 and C2 is formed by pattern-coating the electroconductive material paste such as Ag by the screen printing or the like and then by baking the paste.

The surface protecting layer 304 is provided so as to cover a whole of the heater substrate surface except for the electrode portions C1 and C2. In this embodiment, the surface protecting layer 304 is formed of glass by pattern-coating a glass paste by the screen printing or the like and then by baking the paste. The surface protecting layer 304 is used for protecting the heat generating resistors 301-1 and 301-2 and for maintaining electrical insulation.

The electric power is supplied between the electrode portions C1 and C2, so that each of the heat generating resistors 301-1 and 301-2 connected in series generates heat. The heat generating resistors 301-1 and 301-2 are made to have the same length. The length region of these heat generating resistors 301-1 and 301-2 constitutes the maximum heat generation region width A. A center-basis feeding line (phantom line) O for the sheet P is located at a position substantially corresponding to a bisection position of the maximum heat generation region width A of the heater 300.

In the heater 300 in this embodiment, in order to improve an end portion fixing property of the image, a heat generation distribution of each of the heat generating resistors 301-1 and 301-2 is set so that an amount of heat generation at an end portion E in a heat generation region is higher than an amount of heat generation at a central portion in the heat generation region (end portion heat generating resistor drawing). This will be described later.

The heater 300 is fitted into the heater fitting groove 201*a* of the heater supporting member 201 so that the front surface thereof is directed upward and so that the high heat-conductive member 220 is interposed between the heater back surface and the heater supporting member 201 in the groove 201*a*, and thus is supported by the heater supporting member 201. The high heat-conductive member 220 is a member for suppressing a non-sheet-passing portion temperature rise during continuous sheet passing of the small-sized paper, and is interposed between the heater back surface and the heater supporting member 201 by being sandwiched between the heater back surface and a bearing surface of the groove 201*a*.

In FIG. 4, (a) shows a state in which the high heat-conductive member 220 having a size and a shape such that the high heat-conductive member 220 covers a range longer than at least the heat generation region of the heat generating resistors 301-1 and 301-2 is disposed superposedly on the heater substrate back surface. The high heat-conductive member 220 is disposed at the heater substrate back surface so as to cover at least a region corresponding to the maximum heat generation region width A of the heater 300.

The high heat-conductive member 220 is sandwiched and interposed between the heater back surface and the bearing surface of the groove 201*a* in a state in which the heater 300 is fitted into the heater fitting groove 201*a* of the heater supporting member 201 with the upward front surface and is thus supported by the heater supporting member 201. Further, the high heat-conductive member 220 is sandwiched and pressed between the heater supporting member 201 and the heater 300 by the pressing force of the above-described pressing mechanisms 252 (L, R).

FIG. 5 is an enlarged view of FIG. 2 in a region where the film 202 and the pressing roller 208 contact each other. The sheet P and the pressing roller 208 are omitted from illustration. The inner surface of the film 202 and the (front) surface of the surface protecting layer 304 of the heater 300 contact each other to form the nip N between the film 202 and the pressing roller 208. A region N (nip) is a contact region between the film 202 and the pressing roller 208, and a region NA is a contact region between the film 202 and the heater 300. The region NA is hereinafter referred to as an inner surface nip.

The high heat-conductive member 220 is a member higher in thermal conductivity than the heater 300. In this embodiment, as the high heat-conductive member 220, an anisotropic heat-conductive member higher in thermal conductivity with respect to a planar (surface) direction than the heater substrate 303 is used.

Compared with the heater substrate 303, as a material having a high thermal conductivity with respect to the planar direction, it is possible to use a flexible sheet-shaped member or the like using, e.g., graphite. That is, the high heat-conductive member 220 in this embodiment is the flexible sheet-shaped member using graphite as the material therefor, and the thermal conductivity with respect to a sheet surface direction (parallel to the sheet surface) thereof is higher than the thermal conductivity of the heater 300. In this embodiment, as the high heat-conductive member 220, the graphite sheet of 1000 V/mK in thermal conductivity with respect to the planar direction, 15 W/mK in thermal conductivity with respect to a thickness direction, 70 μm in thickness and 1.2 g/cm$^3$ in density was used.

Further, for the high heat-conductive member 220, a thin metal material such as aluminum higher in thermal conductivity than the heater 300 (heater substrate 303) may also be used.

A thermistor (temperature detecting element) 211 and a protecting element 212, such as a thermoswitch, a temperature fuse or a thermostat, in which a switch is provided are contacted to the high heat-conductive member 220, and are configured to receive the heat from the heater 300, via the high heat-conductive member 220, fitted into and supported by the heater fitting groove 201*a* of the heater supporting member 201. The thermistor 211 and the protecting element 212 are pressed against the high heat-conductive member 212 by an urging member (not shown) such as a leaf spring. The thermistor 211 contacts the high heat-conductive member 220 through a first hole ET1 provided in the heater supporting member 201. A pressure per unit area A to the high heat-conductive member 220 by the thermistor 211 is smaller than a pressure per unit area applied to a first region E1 described later. Further, the protecting element 212 contacts the high heat-conductive member 220 through a second hole ET2 provided in the heater supporting member 201. Also a pressure per unit area applied to the protecting element 212 by the protecting element 212 is smaller than a pressure per unit area applied to the protecting element 212.

The thermistor 211 and the protecting element 212 are positioned and disposed in one end side and the other end side, respectively, with respect to the center basis feeding line O as a boundary as shown in (b) of FIG. 4. Further, both the thermistor 211 and the protecting element 212 are disposed in the passing region of a minimum-sized sheet P capable of passing through the fixing device 200. The thermistor 211 is the temperature detecting element for temperature-controlling the heater 300 as described above. The protecting element 212 is connected in series to an energization circuit to the heater 300 as shown in FIG. 6, and operates when the heater 300 is abnormally increased in temperature to interrupt an energization line to the heat generating resistors 301-1 and 301-2.

(4) Electric Power Controller for Heater 300

Figure 7:
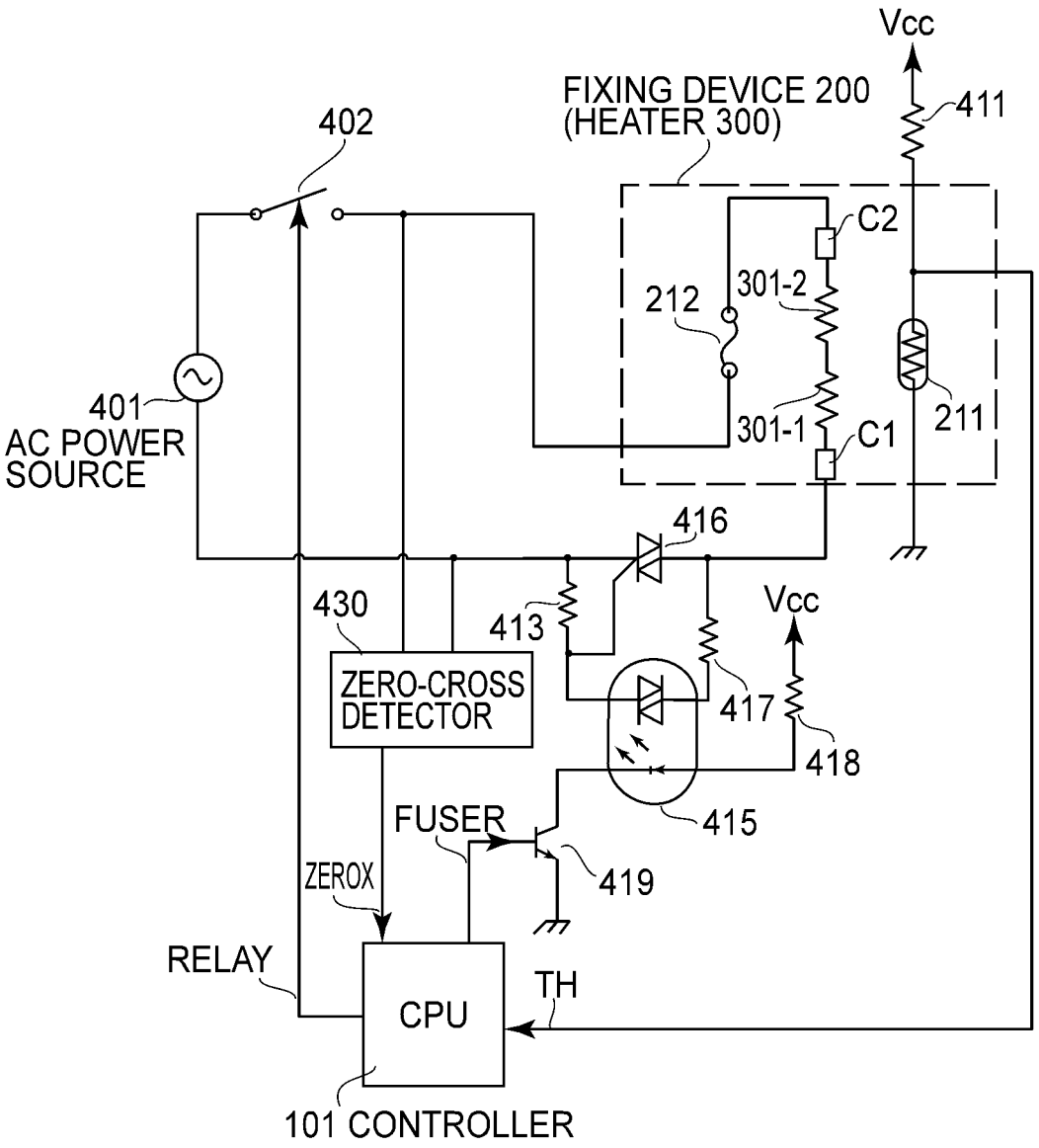
FIG. 7 is a control circuit diagram of the heater.

FIG. 7 shows an electric power controller for the heater 300 in this embodiment, in which a commercial AC power source 401 is connected to the printer 100. The electric power control of the heater 300 is effected by energization and interruption of a triac 416. The electric power supply to the heater 300 is effected via the electrode portions C1 and C2, so that the electric power is supplied to the heat generating resistors 301-1 and 301-2 of the heater 300.

A zero-cross detecting portion 430 is a circuit for detecting zero-cross of the AC power source 401, and outputs a zero-cross ("ZEROX") signal to the controller (CPU) 101. The ZEROX signal is used for controlling the heater 300, and as an example of a zero-cross circuit, a method described in JP-A 2011-18027 can be used.

An operation of the triac 416 will be described. Resistors 413 and 417 are resistors for driving the triac 416, and a photo-triac coupler 415 is a device for ensuring a creepage distance for insulation between a primary side and a secondary side. The triac 416 is turned on by supplying the electric power to a light-emitting diode of the photo-triac coupler 415. A resistor 418 is a resistor for limiting a current of the light-emitting diode of the photo-triac coupler 415. By controlling a transistor 419, the photo-triac coupler 415 is turned on and off.

The transistor 419 is operated by a "FUSER" signal from the controller 101. A temperature detected by the thermistor 211 is detected by the controller in such a manner that a divided voltage between the thermistor 211 and a resistor 411 is inputted as a "TH" signal into the controller 101. In an inside process of the controller 101, on the basis of a detection temperature of the thermistor 211 and a set temperature for the heater 300, the electric power to be supplied is calculated by, e.g., PI control. Further, the electric power is converted into control level of a phase angle (phase control) and wave number (wave number control) which correspond to the electric power to be supplied, and then the triac is controlled depending on an associated control condition.

For example, in the case where the fixing device 200 is in a thermal runaway state by a breakdown, of the electric power controller, such as short circuit of the triac 416, the protecting element 212 operates, and interrupts the electric power supply to the heater 300. Further, in the case where the controller 101 detects that the thermistor detection temperature ("TH" signal) is a predetermined temperature or more, the controller 101 places a relay 402 in a non-energization state, and thus interrupts the electric power supply to the heater 300.

(5) Pressing Method of Heater and High Heat-Conductive Member

Figure 8:
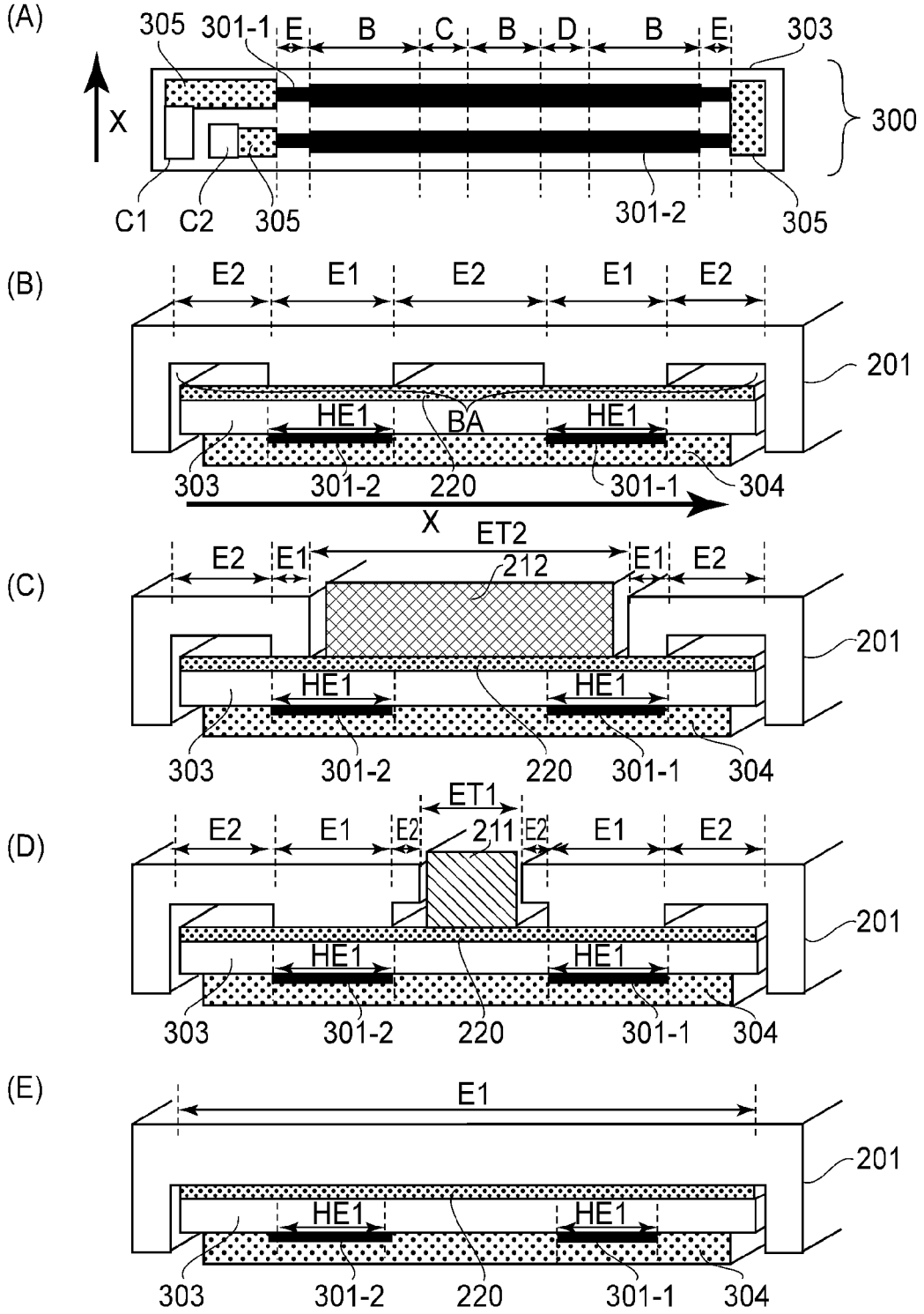
In FIG. 8, (A) to (E) are illustrations of a pressing method of the heater and a high heat-conductive member.

In FIG. 8, (A) to (E) are schematic views for illustrating a pressing method of the heater 300 and the high heat-conductive member 220 and a shape of the heater supporting member 201. The high heat-conductive member 220 is, as described above, sandwiched between the heater supporting member 201 and the heater 300 in a pressed state by the pressing force of the pressing mechanisms 252 (L, R).

In a bottom region (region BA in (B) of FIG. 8) where the supporting member 201 supports the heater 300, the supporting member 201 in this embodiment has a first region (region E1 in FIG. 8) where the supporting member contacts the high heat-conductive member so that the pressure is applied between the heater and the high heat-conductive member and has a second region (region E2) where the supporting member is recessed from the high heat-conductive member relative to the first region. Further, at least a part of the first region E1 overlaps with a region (HE1), where the heat generating resistor 301-1 or 301-2 is provided, with respect to a recording material movement direction (direction X). A region ET1 provided in the supporting member 201 is a first hole in which the thermistor 211 is disposed, and a region ET2 is a second hole in which the protecting element 212 is disposed.

This will be specifically described below. In FIG. 8, (A) is the schematic view of the heater 300 in the front side, and (B) is a sectional view showing a cross-section of the heater 300 in a central region B with respect to a longitudinal direction of the heater 300.

In FIG. 8, (c) is a sectional view showing a cross-section of the heater 300 in a region C where the protecting element 212 is contacted to the high heat-conductive member 220 with respect to the longitudinal direction of the heater 300.

In FIG. 8, (D) is a sectional view showing a cross-section of the heater 300 in a region D where the thermistor 211 is contacted to the high heat-conductive member 220 with respect to the longitudinal direction of the heater 300.

Figure 11:
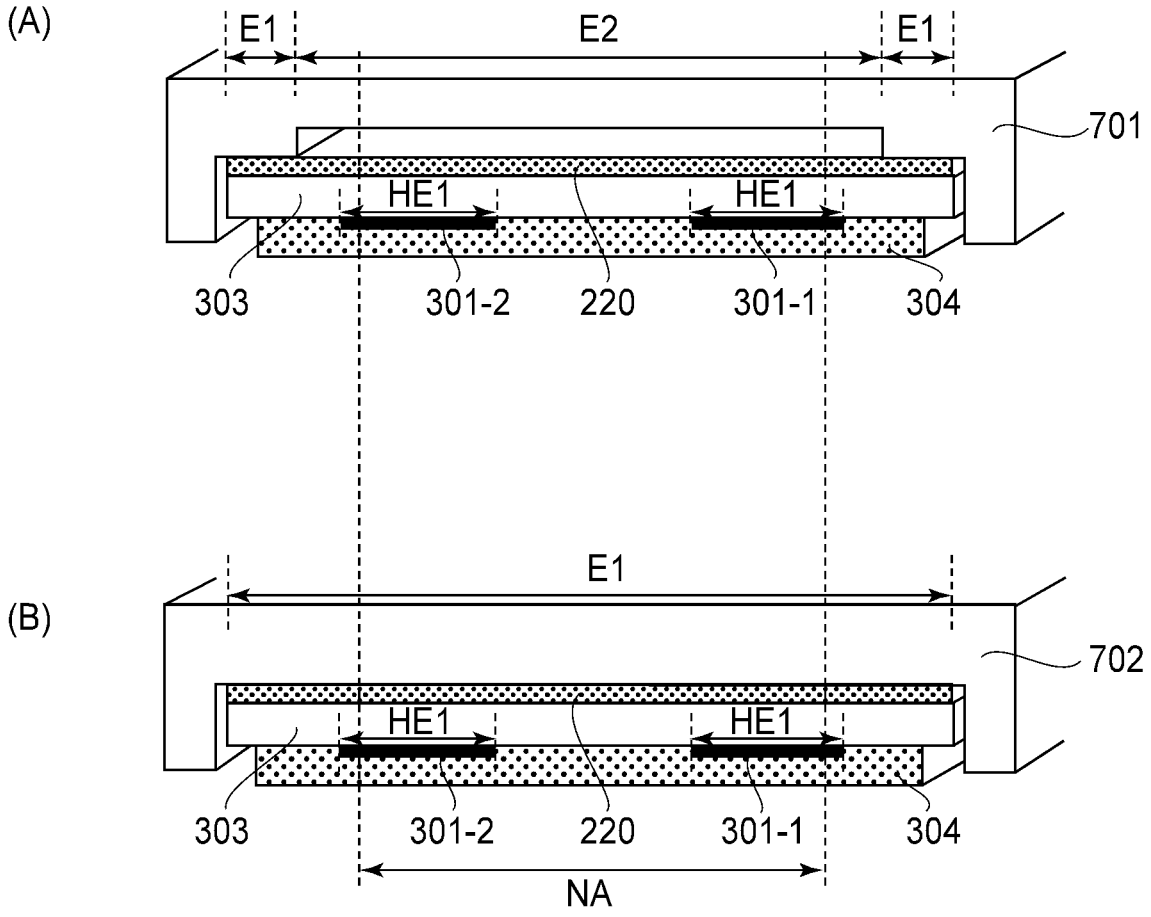
In FIG. 11, (A) and (B) are illustrations of a pressing method of a heater and a high heat-conductive member in Comparison Example.

In FIG. 11, (A) is a sectional view showing a cross-section in a longitudinal central region (corresponding to the region B in (A) of FIG. 8) in the case where a heater supporting member 701 in Comparison Example is used. The region E1 of the supporting member 701 does not overlap with the region HE1 where the heat generating member 301-1 or 301-2 is provided.

In FIG. 11, (B) is a sectional view showing a cross-section in a longitudinal central region (corresponding to the region B in (A) of FIG. 8) in the case where a heater supporting member 702 in Comparison Example is used. The supporting member 701 does not have a region E2.

As described above with reference to (B) to (D) of FIG. 8, the region E1 of the supporting member 201 overlaps with the region HE1, where the heat generating member 301-1 or 301-2 is provided, with respect to the recording material movement direction. That is, the high heat-conductive member 220 is pressed against the heater 300 at a position very close to the position where the heat generating member 301-1 or 301-2 is provided. For that reason, the influence of heat resistance of the heater substrate 303 until the heat generated by the heat generating members reaches the high heat-conductive member can be reduced, so that the heat generated by the heat generating resistors 301-1 and 301-2 can be efficiently conducted to the high heat-conductive member 220.

Further, at least a part of the second region E2 is provided at a position opposing the high heat-conductive member 220, and at least a part of the second region E2 opposes a region out of the region HE1, where the heat generating member of the heater 300 is provided, with respect to the recording material movement direction X. For that reason, it is possible to suppress heat dissipation from the high heat-conductive member 220 into the heater supporting member 201. In this embodiment, all the first regions E1 excluding the end portion regions E overlap with the regions HE1. Further, all the second regions E2 oppose heater regions out of the regions E1. Further, as shown in (B) of FIG. 8, the respective regions are constituted so as to decrease the contact area between the high heat-conductive member 220 and the heater supporting member 201. For that reason, it is possible to reduce the heat dissipation into the heater supporting member 201, so that a rise time of the image heating apparatus can also be improved simultaneously.

A longitudinal heat generation distribution of each of the heat generating resistors 301-1 and 301-2 of the heater 300 is set so that an amount of heat generation at the end portion E ((A) of FIG. 8) in the heat generation region is higher than an amount of heat generation at the central portion in the heat generation region. Hereinafter, an operation of increasing the heat generation amount of each of the heat generating resistors 301-1 and 301-2 at the end portion E in the heat generation region is referred to as the end portion heat generating member drawing.

In FIG. 8, (E) is a sectional view showing a cross-section of the heater 300 of (A) in FIG. 8 in the longitudinal end portion region E. As shown in (E) of FIG. 8, the heater 300 and the high heat-conductive member 220 are contacted to each other at the whole surface. The heat generation amount at the end portion E in the heat generation region is high, and therefore thermal stress generated at a heater substrate portion corresponding to the end portion E in the heat generation region when the heater 300 is in the thermal runaway state is larger than the heat generation amount at the heater substrate central portion B and the like in some cases.

In such a cases, at the end portion E in the heat generation region, the thermal stress generated in the heater substrate 303 can be alleviated increasing a region where the high heat-conductive member 220 and the heater 300 are pressed by the heater supporting member 201 to be contacted to each other.

In this way, a width of the first region E1 at the longitudinal end portion E of the heater is larger than a width of the first region E1 at the longitudinal central portion of the heater. That is, with respect to the longitudinal direction of the supporting member, a constitution in which there is no second region E2 at the end portion E in the bottom region or in which the second region E2 is narrower at the end portion E than at the central portion B is employed.

Figure 12:
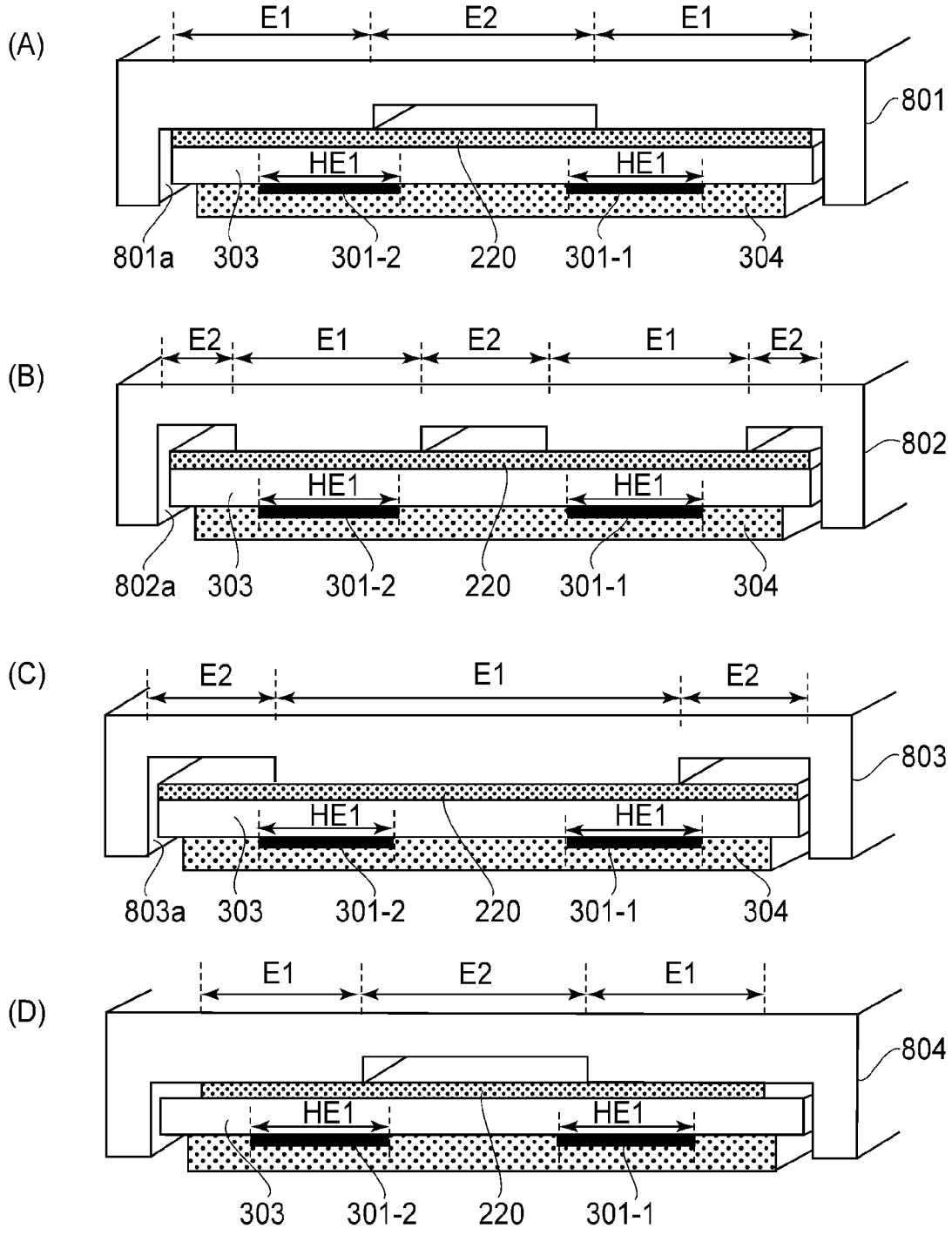
In FIG. 12, (A) to (D) are illustrations of a modified example of a heater supporting member.

As a constitution other than the constitution as shown in (E) of FIG. 8 in which the heater 300 and the high heat-conductive member 220 are contacted to each other at the whole surface, e.g., a constituting using a heater supporting member 802 shown in (B) of FIG. 12 may also be employed. That is, at the end portion E, the region E2 is provided, and in addition, the region R1 may be made broader than the region HE1.

Further, even in the case of a heater, in which the end portion heat generating member drawing is not made, as in the case of a heater 900 in a modified example of Embodiment 1 shown in (A) of FIG. 13 described later, the thermal stress at the end portion E is larger than the thermal stress at the central portion in the heater heat generation region in some cases. For that reason, also with respect to the case where the end portion heat generating member drawing is not made as in the case of the heater 900 shown in (A) of FIG. 13, in the end portion region E in the heat generation region, the region E1 is increased. As a result, an effect of alleviating the thermal stress of the heater substrate 303 is obtained.

Incidentally, as shown in (E) of FIG. 8, at the end portion E in the heat generation region, even when the region E1 is increased, a position of the end portion E is spaced from the thermistor 211 and the protecting element 212. For that reason, even when the amount of the heat dissipation into the supporting member becomes large at the end portion E, the large heat dissipation amount little influence response properties of the protecting element 212 and the thermistor 211.

Accordingly, the above-described effect of improving the response properties of the protecting element 212 and the thermistor 211 and the above-described effect of alleviating the thermal stress of the heater 300 at the end portion E in the heat generation region can be obtained concurrently. The response properties of the protecting element and the thermistor are improved, and therefore when the heater 300 causes the thermal runaway, it is possible to interrupt the electric power supply to the heater 300 early and to prolong a time until the heater 300 is broken by the thermal stress, so that reliability of the image heating apparatus 200 can be further enhanced.

Figure 9:
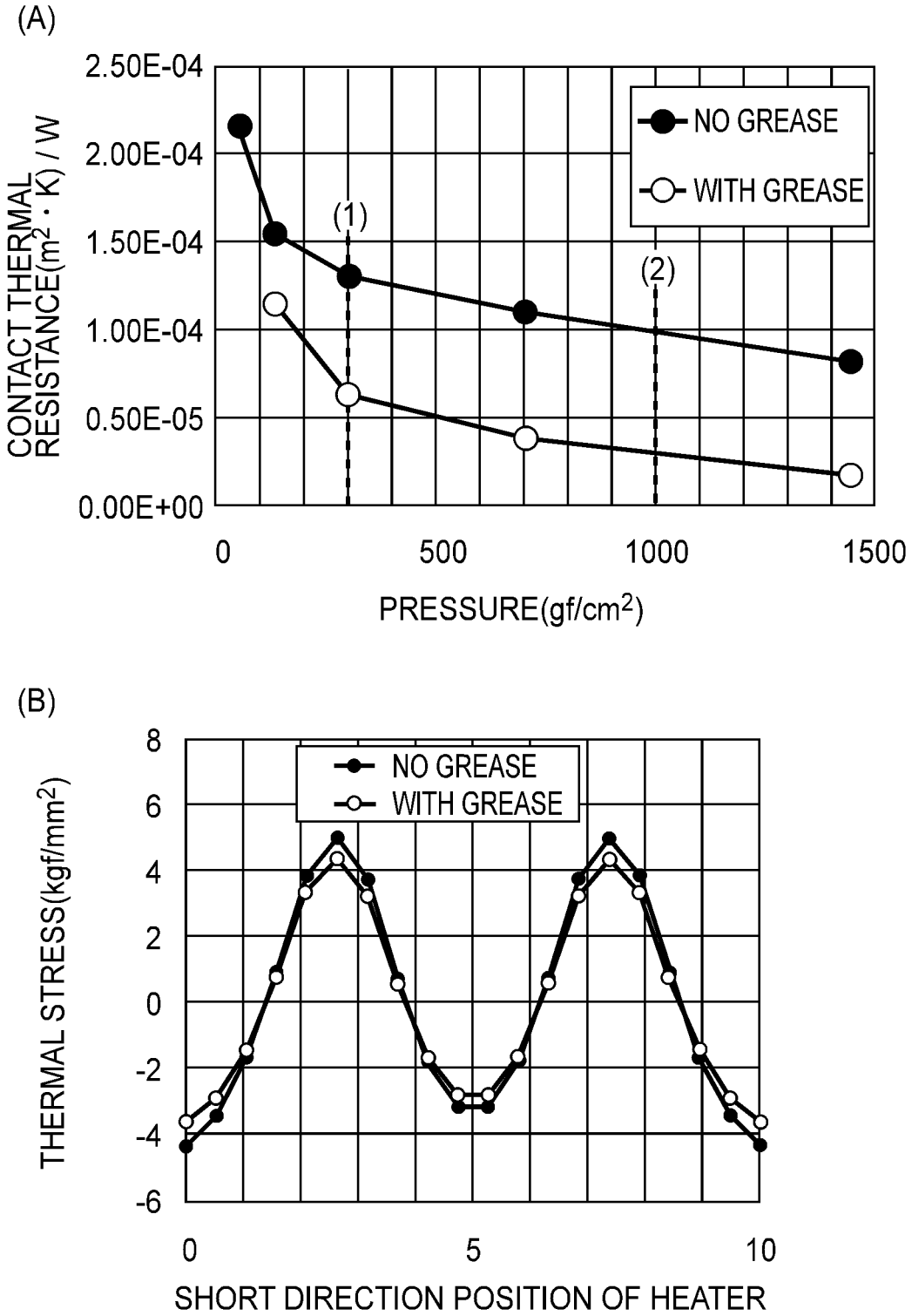
In FIG. 9, (A) is a graph showing a relationship between a pressure and a contact thermal resistance of the heater and the high heat-conductive member, and (B) is a graph showing a relationship between a short direction position of the heater and a thermal stress of a heater substrate.

In FIG. 9, (A) is a graph showing a relationship between the pressure (pressing force) between the heater 300 and the high heat-conductive member 220, and a contact thermal resistance between the heater 300 and the high heat-conductive member 220, and (B) is a graph showing the influence of the contact thermal resistance between the heater 300 and the high heat-conductive member 220 on the stress in the heater substrate 303 during the thermal runaway. Each of (A) and (B) of FIG. 8 is a result of simulation.

In a graph of (A) of FIG. 8 plotted by black (close) circles ("●") shows the relationship between the contact thermal resistance and the pressure in the case where grease or the like for increasing a degree of heat conduction is not provided between the high heat-conductive member 220 and the heater 300. This graph shows that the heat conduction cannot be obtained in most cases in the region E2 where the high heat-conductive member 220 and the heater 300 are in a non-pressure state. That is, a predetermined pressure is required to obtain the heat conduction between the high heat-conductive member 220 and the heater 300. For that reason, the heater supporting member 201 in this embodiment is constituted so that the heat from the heat generating member is easily conducted to the high heat-conductive member by causing at least the part of the first region E1 to overlap with the region HE1, where the heat generating member is provided, with respect to the recording material movement direction X. On the other hand, the contact thermal resistance between the heater and the high heat-conductive member in the region E2 is large, and therefore the heat from the heat generating member is not readily conducted to the high heat-conductive member. That is, in the region E2, the heat is also not readily conducted from the high heat-conductive member to the supporting member. Accordingly, at least the part of the region E2 is provided in the region out of the region HE1 with respect to the recording material movement direction X, whereby an increase in time required for rising the fixing device (i.e., a time until the heater temperature reaches a fixable temperature) can be suppressed.

Incidentally, at a position of the supporting member 201 shown in (B) of FIG. 8, the contact area (area of the region E1) between the heater 300 and the high heat-conductive member 220 is about 30% of the heater width. For that reason, compared with the case where the region E1 is provided at the whole surface of the heater, it is possible to increase the pressure between the heater 300 and the high heat-conductive member 220.

The pressure in the case where the heater supporting member 702 ((B) of FIG. 11) in Comparison Example in which a proportion of the region E1 to the heater width is 100% is about 300 gf/cm$^2$ (shown by (1) in (A) of FIG. 9). In the case where the pressure applied to the whole of the heater 300 is constant, when the heater supporting member 201 in this embodiment (in which the proportion of the region E1 is 30%) is used, the pressure becomes about 1000 gf/cm$^2$ (shown by (2) in (A) of FIG. 9), and therefore the contact thermal resistance between the heater 300 and the high heat-conductive member 220 can be reduced by about 30%.

By providing not only the region E1 but also the region E2, an effect of decreasing the contact thermal resistance per unit area between the heater 300 and the high heat-conductive member 220 is obtained. For that reason, the heat generated by the heat generating resistors 301-1 and 301-2 can be efficiently conducted to the high heat-conductive member 220.

Further, in a graph of (B) of FIG. 8 plotted by white (open) circles ("○") shows the relationship between the contact thermal resistance and the pressure in the case where heat-conductive grease as an adhesive material (heat-conductive material) is applied between the high heat-conductive member 220 and the heater 300. This graph shows that by interposing the adhesive material such as the grease, the contact thermal resistance between the high heat-conductive member 220 and the heater 300 can be decreased. For that reason, depending on necessity for decreasing the contact thermal resistance, the adhesive material such as the grease may also be applied between the high heat-conductive member 220 and the heater 300.

Figure 14:
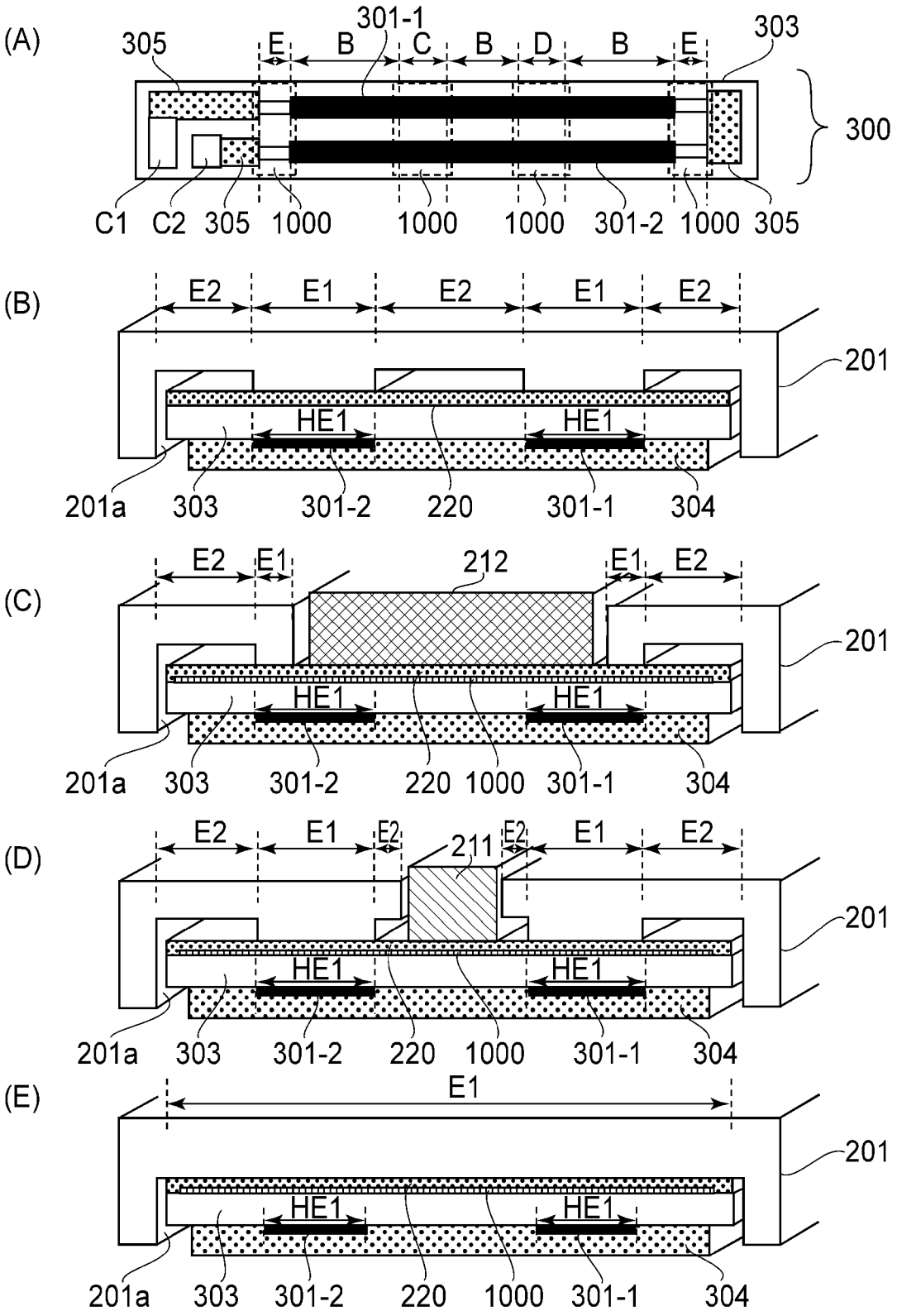
In FIG. 14, (A) to (E) are illustrations in the case where a heat-conductive grease is used.

For example, in the case where the pressure for bringing the protecting element 212 and the thermistor 211 into contact with the high heat-conductive member 220 cannot be made high, constitutions shown in (C) and (D) of FIG. 14 may be employed. That is, a heat-conductive grease 1000 may also be applied onto only a region where the protecting element 212 is contacted to the high heat-conductive member 220 and a region where the thermistor 211 is contacted to the high heat-conductive member 220. Further, as shown in (E) of FIG. 14, the grease 10000 may also be applied onto a limited place, where the stress is exerted on the heater substrate 303 when the heater 300 causes the thermal runaway, such as a region where the heat generation amount of the heater 300 is large or the heat generation region end portion E of the heater 300.

Further, as the adhesive material, in place of the grease 10000, an adhesive (heat-conductive adhesive) having high thermal conductivity may also be used. As shown in FIG. 14, by selectively applying the grease 1000, it is possible to decrease a necessary amount of the grease 1000 while satisfying a necessary performance, and therefore the selective application of the grease 1000 is advantageous in that a cost of the fixing device 200 is reduced.

In FIG. 9, (B) is a graph showing a result of simulation of the thermal stress generated in the heater substrate 303 after a lapse of a predetermined time when the heater 300 exhibits the thermal runaway. In (B) of FIG. 9, the thermal stress with respect to a short direction of the heater substrate 303 in the case of (E) of FIG. 8 and the thermal stress with respect to the short direction of the heater substrate 303 in the case where the adhesive material such as the grease 1000 is applied between the high heat-conductive member 220 and the heater 300 as shown in (E) of FIG. 14 are shown.

In the case where the adhesive material such as the grease 1000 is applied between the high heat-conductive member 220 and the heater 300, the contact thermal resistance between the high heat-conductive member 220 and the heater 300 can be decreased. For that reason, the effect of alleviating the thermal stress of the heater 300 can be enhanced by the high heat-conductive member 220. Therefore, as described above, when the heater 300 exhibits the thermal runaway, the application of the grease 1000 particularly at the place where the stress is exerted on the heater substrate 303 is advantageous in that reliability of the image heating apparatus 300 is enhanced.

Figure 10:
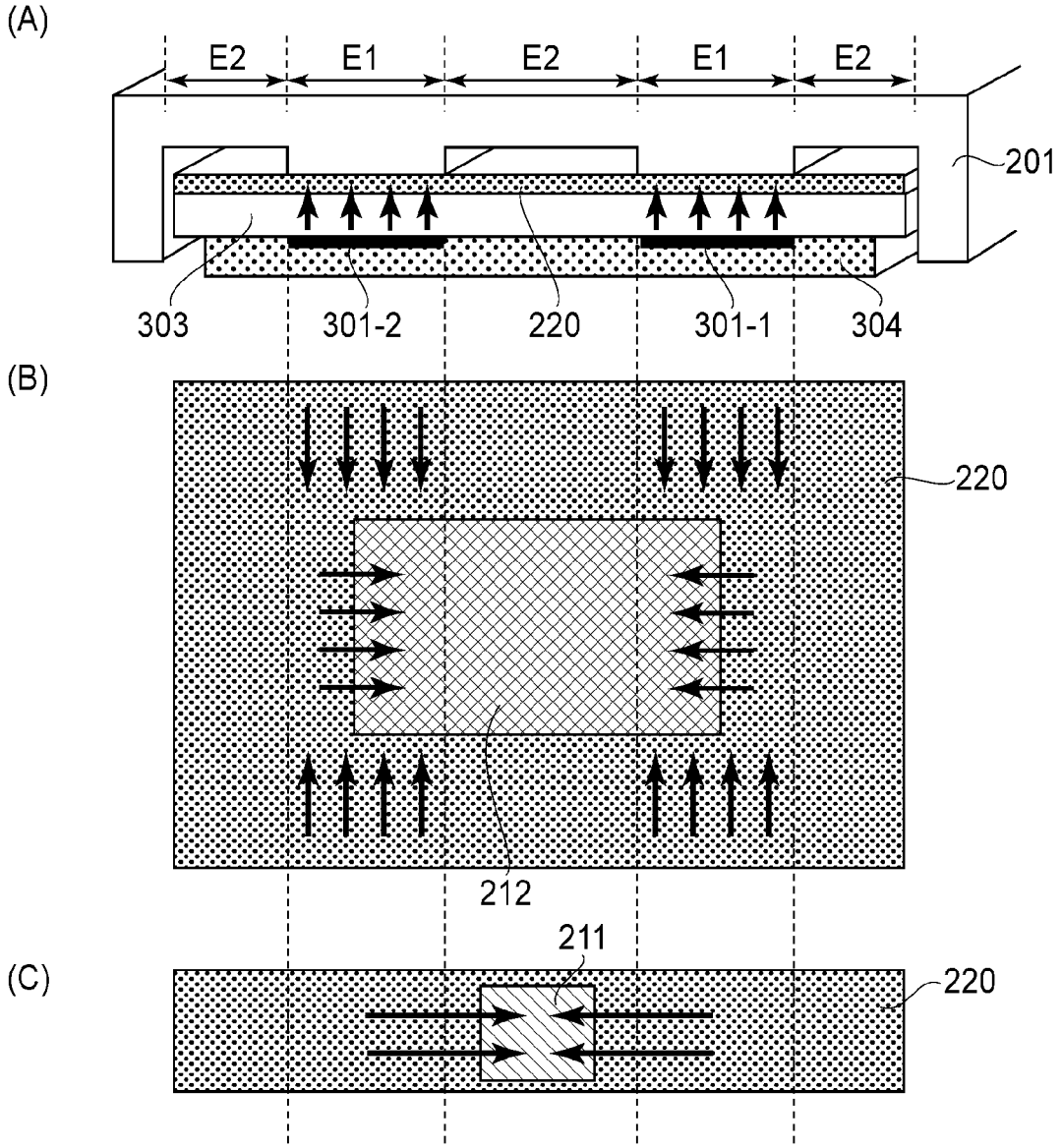
In FIG. 10, (A) to (C) are illustrations of a response-improving effect of a temperature detecting element.

In FIG. 10, (A) to (C) are illustrations of a response-improving effect of the thermistor 211 and the protecting element 212. In (A) of FIG. 10, a flow (arrows) of heat generated in the heat generating resistors 301-1 and 301-2 is added to the sectional view of (B) of FIG. 8.

Particularly, in the case where the graphite sheet is used as the high heat-conductive member, the thermal conductivity of the heater substrate 303 is lower than the thermal conductivity of the high heat-conductive member in the planar direction. Accordingly, when the region E1 and the region HE1 are caused to overlap with each other, the generated heat of the heat generating resistors 301-1 and 301-2 is conducted to the high heat-conductive member 220 via the heater substrate 303 in a shortest distance. In this case, the heat of the heat generating members is conducted inside the heater substrate in a substrate width direction, and therefore, a heat conduction speed is higher than in a route in which the heat is conducted to the protecting element and the thermistor via the high heat-conductive member, so that the response properties of the protecting element and the thermistor are improved.

In FIG. 10, (B) is a bird's-eye view showing a portion (shown in the sectional view of (C) of FIG. 8) where the high heat-conductive member 220 contacts the protecting element 212. A flow of heat generated in the heat generating resistors 301-1 and 301-2 is indicated by arrows. The figure shows that the heat generated in the heat generating resistors 301-1 and 301-2 is conducted to the protecting element 212 via the high heat-conductive member 220 in the longitudinal direction and the short direction of the heater 300.

In a non-pressure region E2 shown in (A) of FIG. 10, heat dissipation from the high heat-conductive member 220 to the heater supporting member 201 is prevented. As a result, when the heater 300 exhibits the thermal runaway, an effect of concentrating the heat generated in the heat generating resistors 301-1 and 301-2 at the protecting element 212 is enhanced.

In FIG. 10, (C) is a bird's-eye view showing a portion (shown in the sectional view of (D) of FIG. 8) where the high heat-conductive member 220 contacts the thermistor 211. A flow of heat generated in the heat generating resistors 301-1 and 301-2 is indicated by arrows. As the thermistor 211 in this embodiment, a member having low thermal capacity compared with the protecting element 212, so that the figure shows the case where the influence of the heat conduction via the high heat-conductive member 220 in the longitudinal direction of the heater is small.

Also in this case, in the non-pressure region E2 shown in (D) of FIG. 8, heat dissipation from the high heat-conductive member 220 to the heater supporting member 201 is prevented. As a result, when the heater 300 exhibits the thermal runaway, an effect of concentrating the heat generated in the heat generating resistors 301-1 and 301-2 at the thermistor 211 is enhanced.

In FIG. 12, (A) to (D) show modified examples of the heater supporting member 201 in Embodiment 1. Each of a heater supporting member 801 in (A), a heater supporting member 802 in (B), a heater supporting member 803 in (C) and a heater supporting member 804 in (D) has a pressure region E1 and a non-pressure region E2.

Further, in these modified example, the heat generating member 801, 802 or 803 has both of the above-mentioned pressure region and non-pressure region at least one common position with respect to the longitudinal direction thereof.

In the modified examples in FIG. 12, compared with the heater supporting member 201 in Embodiment 1, an effect of efficiently conducting the heat generated in the heat generating resistors 301-1 and 301-2 to the high heat-conductive member 220 is decreased in some cases. Further, in some cases, an effect of suppressing the heat dissipation from the high heat-conductive member 220 into the heater supporting member is decreased. However, compared with the heater supporting member 701 in (A) of FIG. 11, it is possible to obtain the effect of efficiently conducting the heat generated in the heat generating resistors 301-1 and 301-2 to the high heat-conductive member 220. Incidentally, in FIG. 12, (D) shows the case where the width of the high heat-conductive member in narrower than in the case of (A) of FIG. 12 (i.e., the width of the high heat-conductive member is narrower than the substrate width of the heater). In this way, the width of the high heat-conductive member may also be narrower than the heater width.

Further, compared with the heater supporting member 702, it is possible to obtain the effect of suppressing the heat dissipation from the high heat-conductive member 220 into the heater supporting member. That is, it is possible to compatibly realize shortening of a time until the temperature of the image heating apparatus reaches a predetermined temperature and shortening of response times of the protecting element and the thermistor.

Figure 13:
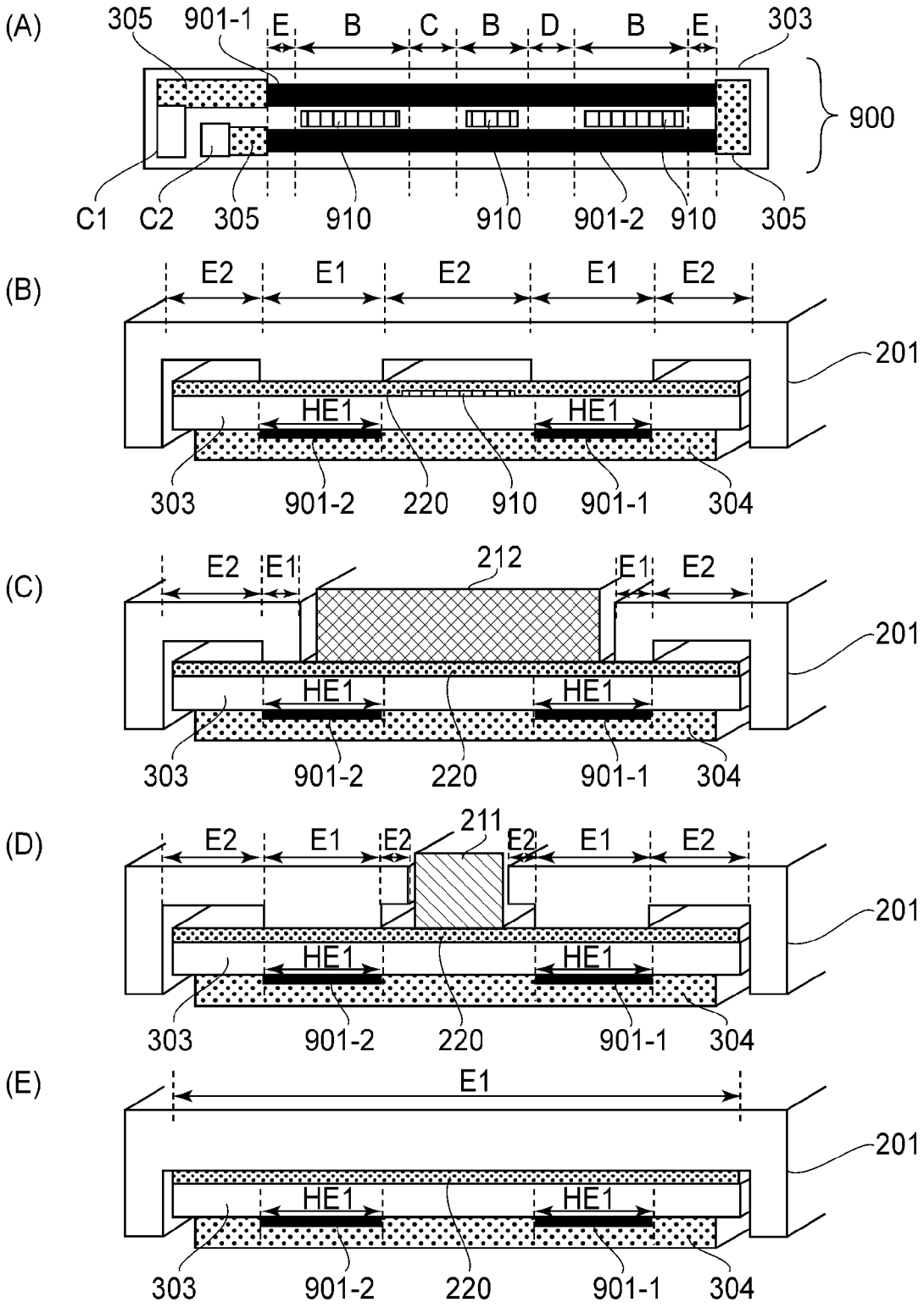
In FIG. 13, (A) to (E) are illustrations in the case where an adhesive is used.

In FIG. 13, (A) to (E) shows a modified embodiment of Embodiment 1, and show an example of the case where a heater 900 and the high heat-conductive member 220 are bonded to each other. This modified embodiment satisfies the conditions that an adhesive has a poor heat-conductive property and the case where an elongation of an adhesive is poor to generate a stepped portion. For that reason, in this modified embodiment, an adhesive 910 is provided between the heater and the high heat-conductive member in a region corresponding to the second region E2, but is not provided between the heater and the high heat-conductive member in a region corresponding to the first region E1. The heater 900 includes heat generating resistors 901-1 and 901-2.

Figure 15:
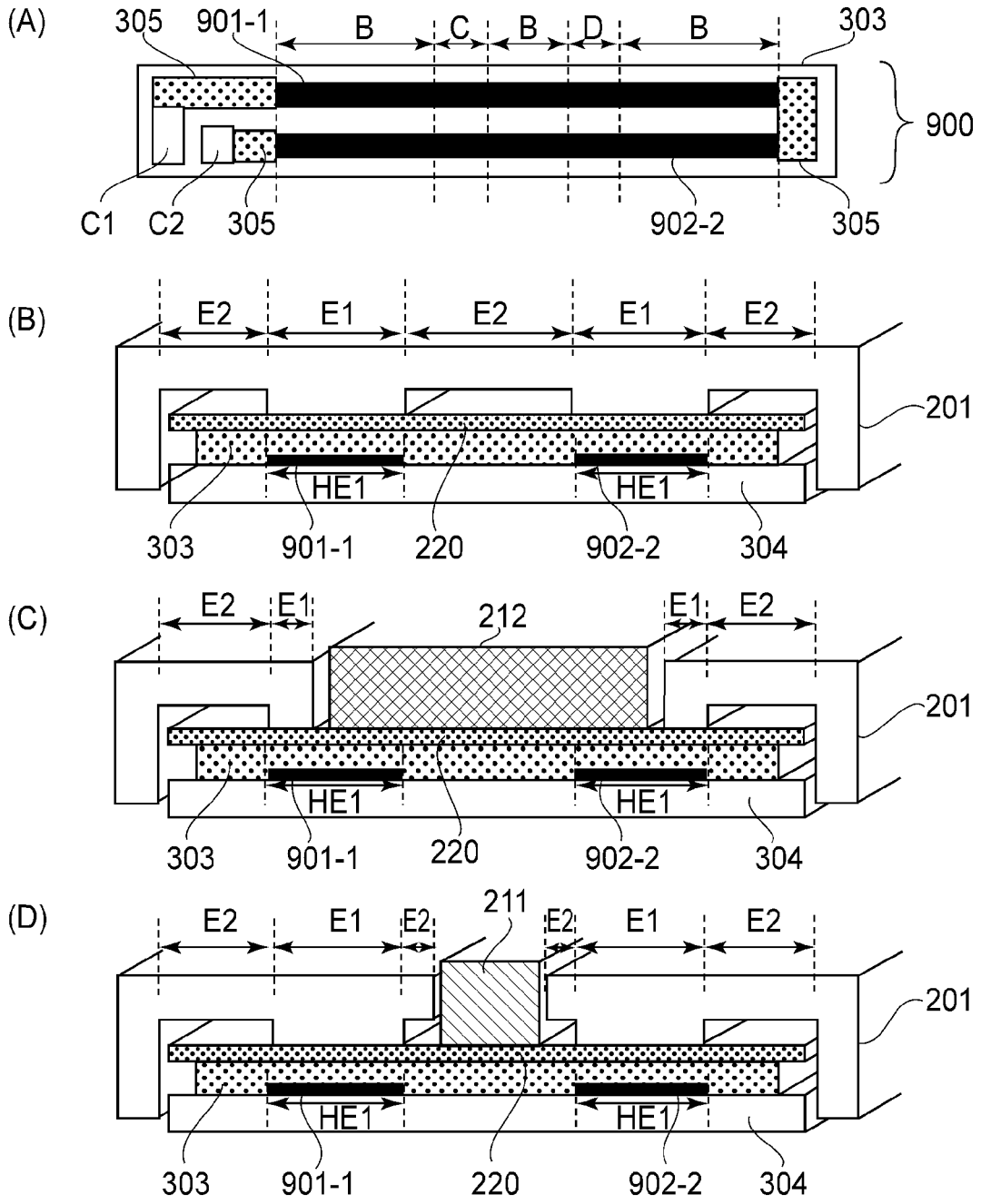
In FIG. 15, (A) to (D) are illustrations in the case where a heat generation surface of the heater is a back surface.

In FIG. 15, (A) to (D) shows a modified embodiment of Embodiment 1, and shows that the present invention is also applicable to the case where the heat generation surface of the heater 900 is disposed in the non-sheet-passing side. That is, a constitution is employed in which the heater 900 is fitted into the heater fitting groove 201 a and is supported by the heater supporting member 201 in a state in which the film sliding surface is disposed so as to be exposed to an outside of the heater supporting member 201 in the heater substrate back surface side opposite from the front surface side, of the heater substrate 304, where the heat generating resistors 901-1 and 902-2 are provided.

Embodiment 2

Embodiment 2 in which the heater mounted in the fixing device 200 is modified will be described. Constituent elements similar to those in Embodiment 1 will be omitted from illustration.

Figure 16:
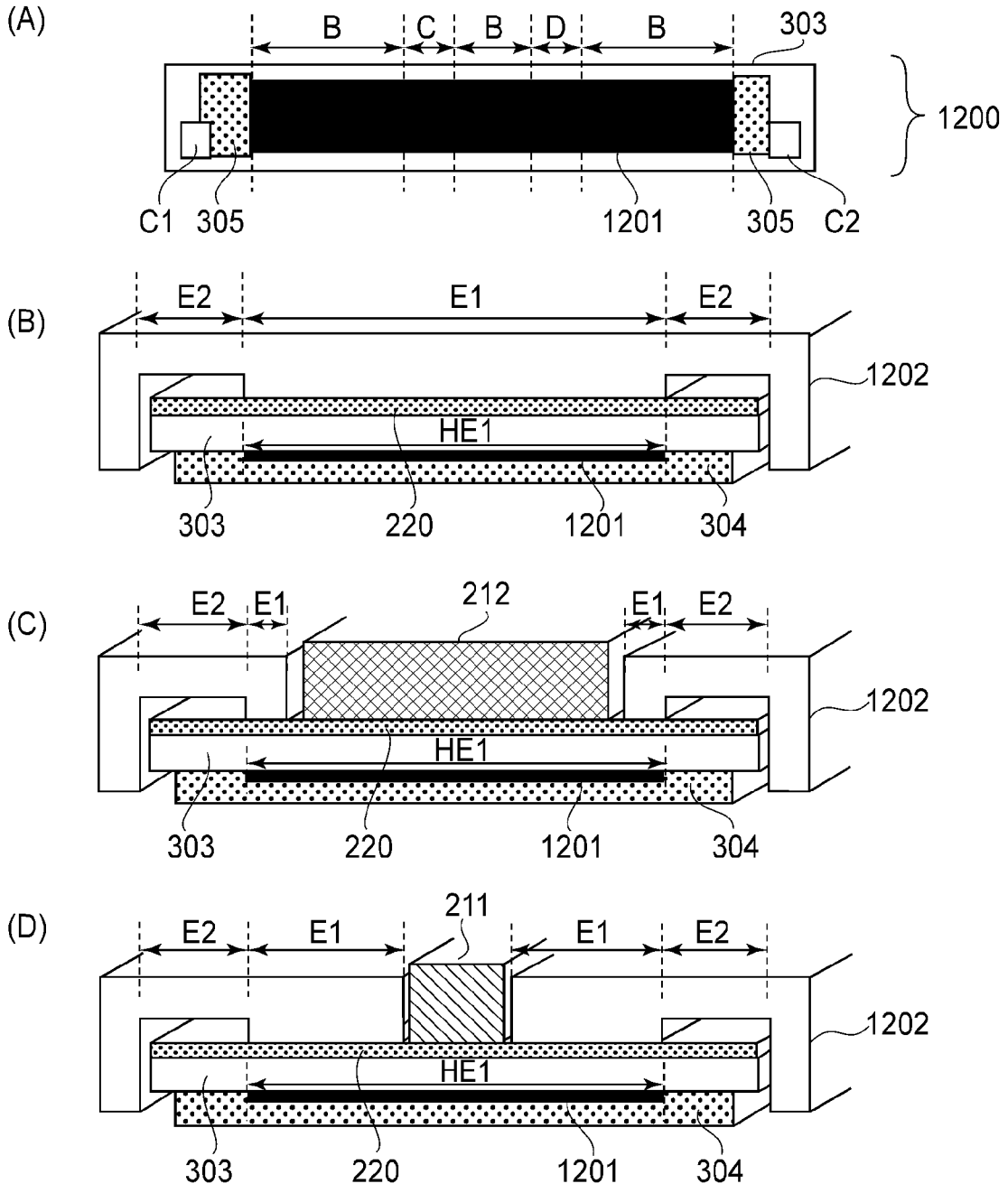
In FIG. 16, (A) to (D) are illustrations of a pressing method of a heater and a high heat-conductive member in Embodiment 2.

In FIG. 16, (A) to (D) are illustrations of a pressing method of a heater 1200 and the high heat-conductive member 220 in this embodiment. In (A) of FIG. 16, to a heat generating resistor 1201 provided along a longitudinal direction of a substrate of the heater 1200, electric power is supplied from the electrode portions C1 and C2 via the electroconductive member 305. The heater 1200 in this embodiment includes the single heat generating resistor 1201. In FIG. 16, (B), (C) and (D) are sectional views of the heater 1200 at positions of B, C and D, respectively, shown in (A) of FIG. 16.

In the cross-section of each of (B) to (D) of FIG. 16, the first region E1 and the second region E2 are provided. The whole of the first region E1 overlaps with the region HE1 of the heat generating member. Further, the whole of the second region E2 opposes an associated region out of the region HE1 of the heater 1200. The heater 1200 includes a heater supporting member 1202

As shown in this embodiment, the constitution of the present invention is applicable to also the heater 1200 including the single heat generating resistor.

Embodiment 3

Embodiment 3 in which the heater mounted in the fixing device 200 is modified will be described. Constituent elements similar to those in Embodiment 1 will be omitted from illustration.

Figure 17:
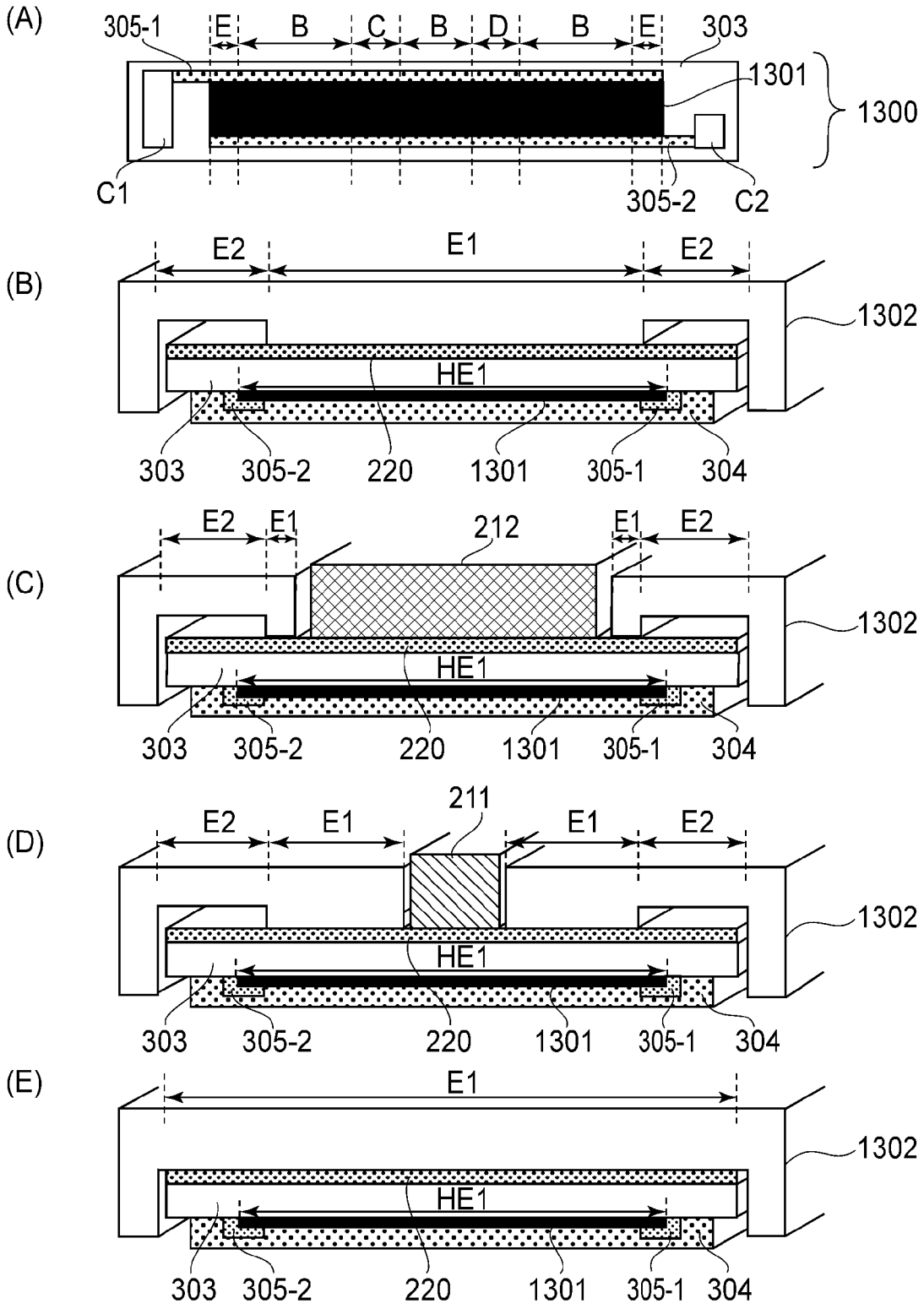
In FIG. 17, (A) to (E) are illustrations of a pressing method of a heater and a high heat-conductive member in Embodiment 3.

In FIG. 17, (A) to (E) are illustrations of a pressing method of a heater 1300 and the high heat-conductive member 220 in this embodiment. In (A) of FIG. 17, to electroconductive members 305-1 and 305-2 provided along a longitudinal direction of a substrate of the heater 1300 and to a heat generating resistor 1301 provided between the two electroconductive members, electric power is supplied from the electrode portions C1 and C2 via the electroconductive members 305-1 and 305-2. The heater 1300 in this embodiment is a heater in which electric power is supplied to the heat generating resistor 1301, and as the heat generating resistor 1301, a heat generating resistor having a positive temperature coefficient (PTC) of resistance is used. In FIG. 17, (B), (C), (D) and (E) are sectional views of the heater 1200 at positions of B, C, D and E, respectively, shown in (A) of FIG. 17.

In the cross-section of each of (B) to (D) of FIG. 17, the first region E1 and the second region E2 are provided. The whole of the first region E1 overlaps with the region HE1 of the heat generating member. Further, the second region E2 not only opposes an associated region out of the region HE1 of the heater 1300 but also extends to a position opposing the region HE1.

A resistance value of each of the electroconductive members 305-1 and 305-2 is very small but is not zero. Accordingly, a longitudinal heat generation distribution of the heat generating resistor 1301 of the heater 1300 is influenced by the resistance values of the electroconductive members 305-1 and 305-2, to that the heat generation amount of the heat generating resistor 1301 at the end portion E is higher than the heat generation amount of the heat generating resistor 1301 at the central portion in some cases. When the heat generation amount at the end portion E in the heat generation region becomes large, the thermal stress generated at the end portion E of the heater substrate 303 when the heater 1300 is in the thermal runaway state is larger than at the central portion of the heat generation region of the heater 1300.

For that reason, as shown in (E) of FIG. 17, at the end portion E in the heat generation region, a contact area is increased by pressing the high heat-conductive member 220 and the heater 1300 by the heater supporting member 1302. As a result, the thermal stress exerted on the heater substrate 303 can be alleviated, so that reliability of the image heating apparatus 200 can be enhanced.

As shown in this embodiment, the constitution of the present invention is applicable to also the heater 1300 in which the electric power is supplied to the heat generating resistor 1301 in the sheet feeding direction.

Embodiment 4

Embodiment 4 in which the heater mounted in the fixing device 200 is modified will be described. Constituent elements similar to those in Embodiment 1 will be omitted from illustration.

Figure 18:
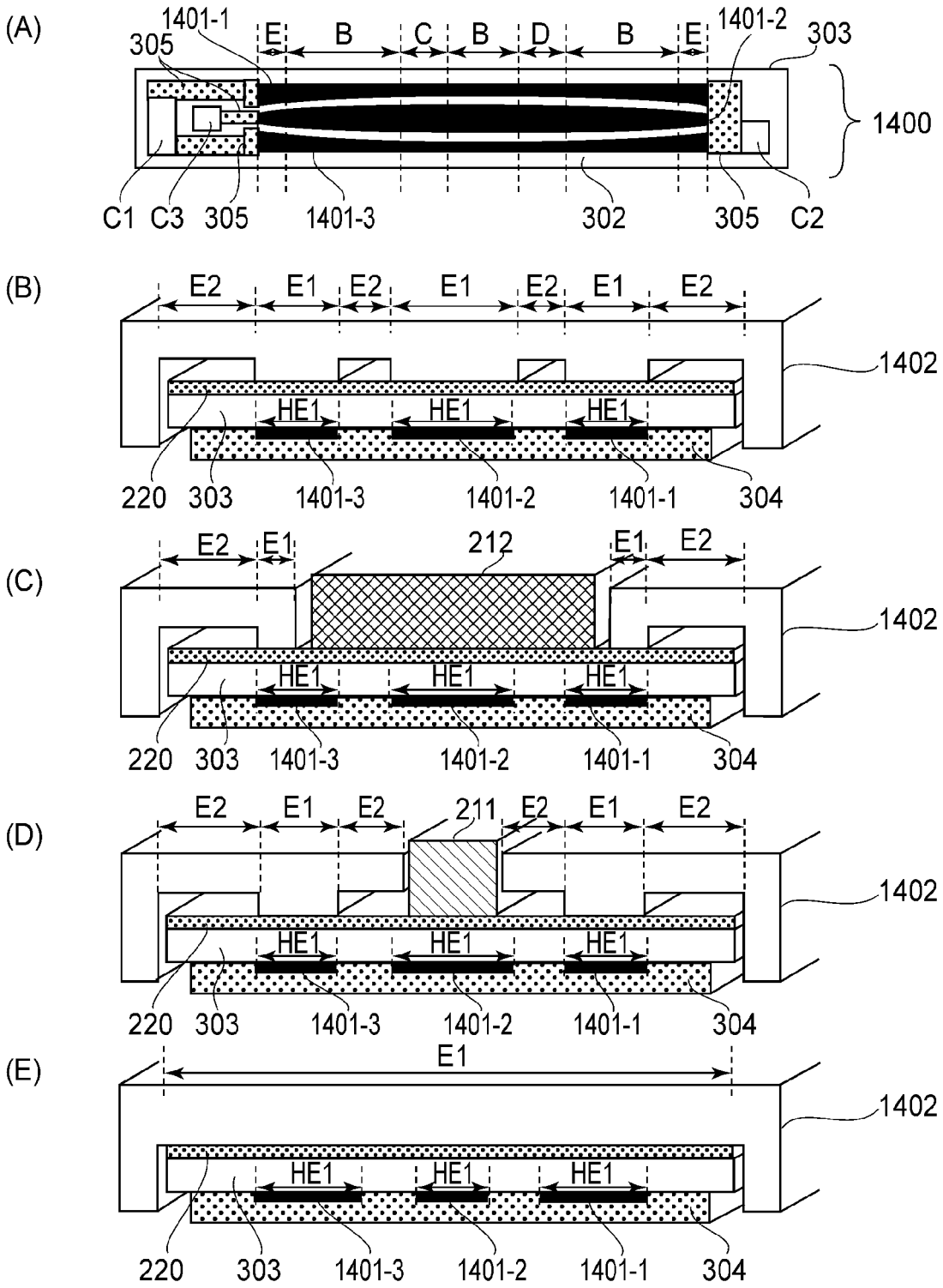
In FIG. 18, (A) to (E) are illustrations of a pressing method of a heater and a high heat-conductive member in Embodiment 4.

In FIG. 18, (A) to (E) are illustrations of a pressing method of a heater 1400 and the high heat-conductive member 220 in this embodiment. A heat generating resistor 1401 of the heater 1400 in this embodiment includes three heat generating resistors 1401-1, 1401-2 and 1401-3.

The heat generating resistors 1401-1 to 1401-3 are electrically connected in parallel, and the electric power is supplied from the electrode portions C1 and C2 via the electroconductive members 305. Further, the heat generating resistor 1401-2, the electric power is supplied from the electric portions C3 and C2 via the electroconductive members 305. The heat generating resistors 1401-1 and 1401-3 always generates heat at the same time, and the heat generating resistor 1401-2 is controlled independently of the heat generating resistors 1401-1 and 1401-3.

Each of the heat generating resistors 1401-1 and 1401-3 has a heat generation distribution such that the heat generation amount at the longitudinal end portion of the heater 1400 is smaller than the heat generation amount at the longitudinal central portion of the heater 1400. The heat generating resistor 1401-2 has a heat generation distribution such that the heat generation amount at the longitudinal end portion of the heater 1400 is larger than the heat generation amount at the longitudinal central portion of the heater 1400. In FIG. 18, (B), (C), (D) and (E) are sectional views of the heater 1200 at positions of B, C, D and E, respectively, shown in (A) of FIG. 18.

In the cross-section of each of (B) to (D) of FIG. 18, the first region E1 and the second region E2 are provided. The whole of the first region E1 overlaps with the region HE1 of the heat generating member. Further, the whole of the second region E2 opposes an associated region out of the region HE1 of the heater 1400, or not only opposes the associated region but also extends to a position opposing the region HE1.

As described above, the heat generation amount of the heat generating resistor 1401 of the heater 1400 at the end portion E is higher than the heat generation amount at the central portion. When the heat generation amount at the end portion E in the heat generation region becomes large, the thermal stress generated at the end portion E of the heater substrate 303 when the heater 1400 is in the thermal runaway state is larger than at the central portion of the heat generation region of the heater 1400. For that reason, as shown in (E) of FIG. 18, at the end portion E in the heat generation region, a contact area is increased by pressing the high heat-conductive member 220 and the heater 1400 by the heater supporting member 1402. As a result, the thermal stress exerted on the heater substrate 303 can be alleviated, so that reliability of the image heating apparatus 200 can be enhanced.

As shown in this embodiment, the constitution of the present invention is applicable to also the heater 1400 including three or more heat generating resistors (1401-1, 1401-2, 1401-3) with respect to the short direction of the heater 1400.

Embodiment 5

Figure 19:
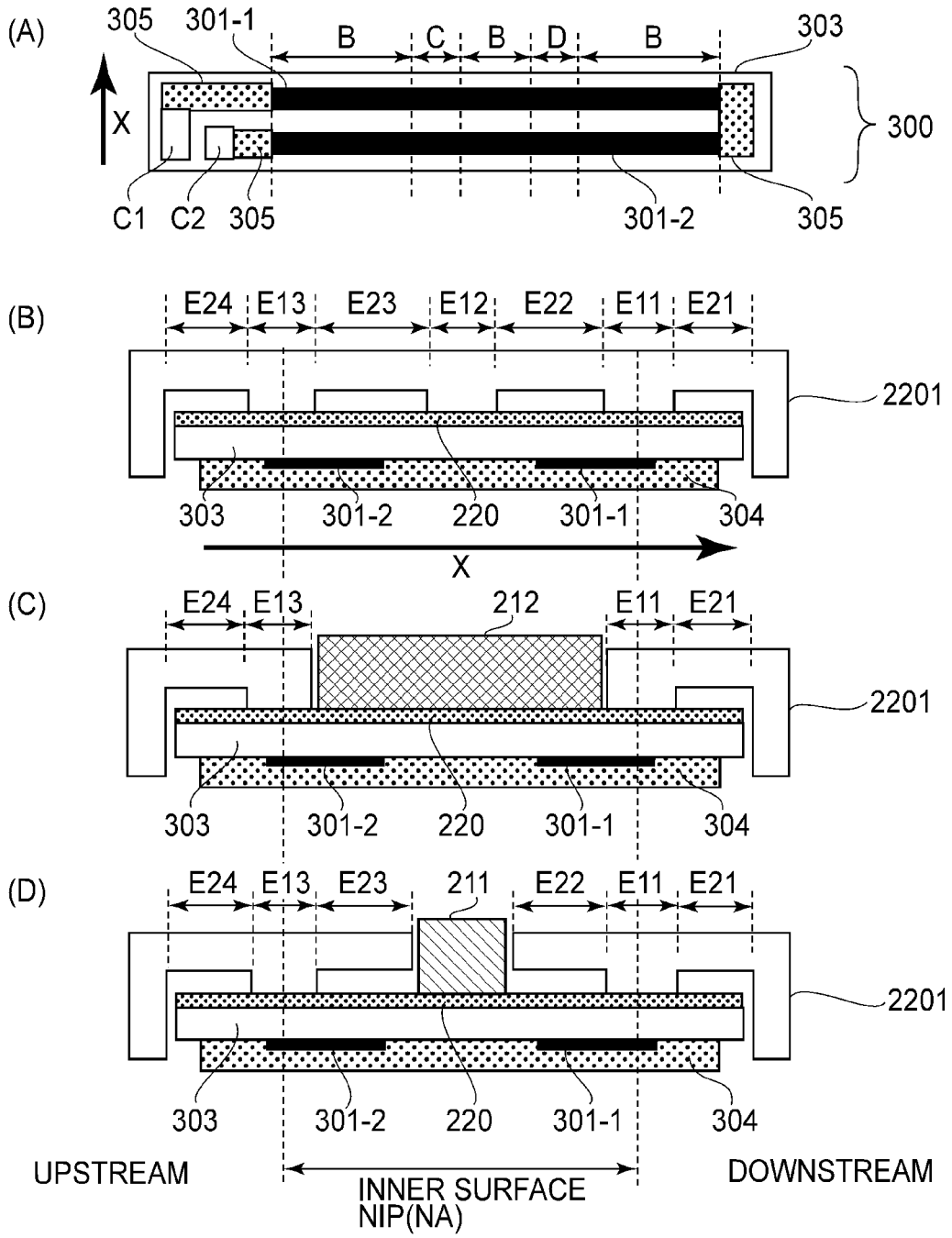
In FIG. 19, (A) to (D) are illustrations of a pressing method of a heater and a high heat-conductive member in Embodiment 5.

In FIG. 19, (A) to (E) are schematic views for illustrating a pressing method of the heater 300 and the high heat-conductive member 220 and a shape of a heater supporting member 2201. The high heat-conductive member 220 is, as described above, sandwiched between the heater supporting member 2201 and the heater 300 in a pressed state by the pressing force of the pressing mechanisms 252 (L, R).

In a bottom region, of the supporting member 2201, corresponding to the region B of the heater 300, first regions (regions E11, E12, E13) where the supporting member contacts the high heat-conductive member so that the pressure is applied between the heater and the high heat-conductive member, and second regions (regions E21, E22, E23, E24) where the supporting member is recessed from the high heat-conductive member relative to the first regions are provided. The first regions includes at least two portions consisting of a first portion E11 corresponding to a downstreammost position of the contact region NA between the film and the heater with respect to the recording material movement direction X and a second portion E11 upstream of the first portion E11 in the contact region NA with respect to the recording material X. Further, at least one second region E22 is provided between the first portion E11 and the second portion E12. Hereinafter, the first portion E11 and the second portion E12 are also referred to as a pressure region 1 and a pressure region 2, respectively.

The pressure region 1 is disposed so as to include a portion positioned downstreammost of the nip (inner surface nip) with respect to the direction X. The pressure region 2 is disposed at a portion positioned upstream of the pressure region 1 with respect to the direction X. A non-pressure region E22 is provided between the regions E11 and E12. The pressure region 2 (E12) is provided at the substantially central portion of the heater with respect to the direction X. With respect to the position of E12 as a reference position, E13 is provided at a position symmetrical to the position of E11.

The above-mentioned constitution will be described specifically. In FIG. 19, (A) is a schematic view of the heater 300 in the front surface side. In FIG. 19, (B), (C) and (D) are sectional views of the heater 300 at positions B, C and D, respectively, shown in (A) of FIG. 19.

The pressure region 1 (E11) is formed so as to include a downstreammost portion of the region NA of the inner surface nip, and the pressure region 2 (E12) is formed sufficiently inside the inner surface nip. Further, a pressure region 3 (E13) is disposed so as to be symmetrical with the pressure region 1 with respect to a short direction center line as a reference line.

Next, in this embodiment, a principle in which the rise time of the fixing device 200 can be shortened will be described with reference to FIGS. 20 and 21.

Figure 20:
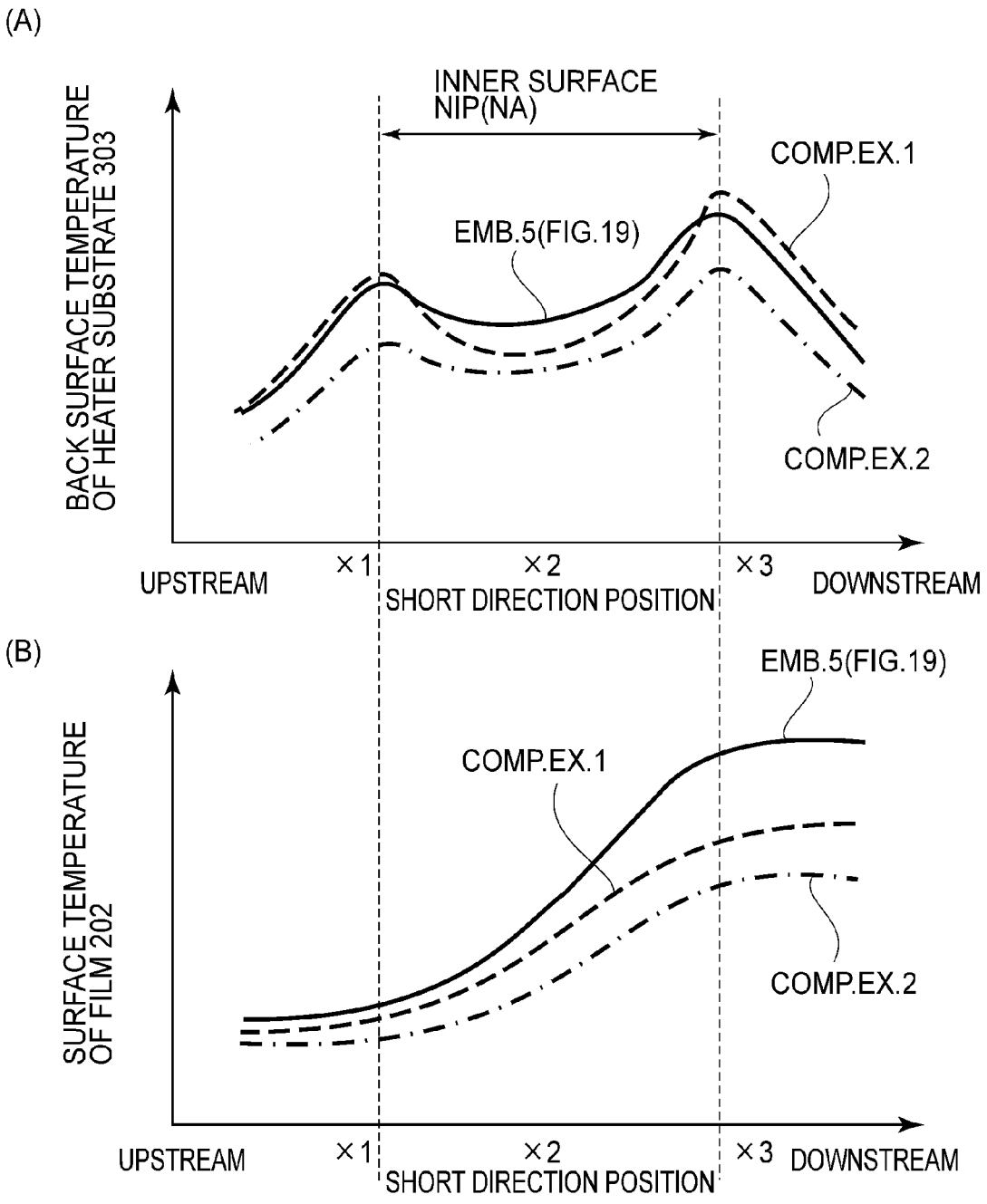
In FIG. 20, (A) is a graph showing a short direction temperature distribution of a back surface temperature of a heater substrate, and (B) is a graph showing a short direction temperature distribution of a film surface temperature.

In FIG. 20, (A) is a graph showing a short direction temperature distribution of the heater 300 at the back surface (oppose from the surface where the heat generating resistors 301-1 and 301-2 are provided) of the heater substrate 303 in Embodiment 5 (this embodiment), Comparison Example 1 (FIG. 11) and Comparison Example 2 (FIG. 11). In FIG. 20, (A) shows a state after a lapse of 4 seconds from rotation drive of the pressing roller 208 at a speed of 300 mm/sec simultaneously with supply of electric power of 1000 W to the heater 300 in a state of 25° C. which is a room temperature.

As shown in (A) of FIG. 20, in each of Embodiment 5, Comparison Example 1 and Comparison Example 2, at the back surface of the heater 300, a temperature distribution such that the temperature is high is obtained in a downstream side. Particularly, in a downstreammost side of the region of the inner surface nip, a highest temperature position exists. This is because the heat supplied from the heater 300 to the film 202 at the inner surface nip in the upstream side is moved toward the downstream side by rotational movement.

As shown in the graph of (A) of FIG. 20, when an upstreammost position of the inner surface nip is x1, a central portion position of the heater 300 is x2, and the downstreammost position of the inner surface is x3, a back surface temperature of the heater 300 at each of the positions is as shown in Table 1.

TABLE 1

| | x1 (US)*1 | x2 (CT*2) | x3 (DS*3) |
|---|---|---|---|
| EMB. 5 | 313° C. | 290° C. | 329° C. |
| COMP. EX. 1 | 315° C. | 281° C. | 348° C. |
| COMP. EX. 2 | 284° C. | 272° C. | 317° C. |

*1"US" is upstream.
*2"CT" is central.
*3"DS" is downstream.

From Table 1, when the back surface temperatures of the heater 300 are compared between Embodiment 5 and Comparison Example 1, the temperature at x3 (downstream) is higher in Comparison Example 1, the temperature at x2 is higher in Embodiment 5, and the temperature at x1 is somewhat higher in Comparison Example 1. Further, the temperatures in Comparison Example 2 are lower than those in Embodiment 5 and Comparison Example 1 at all the positions x1, x2 and x3. The reason for this will be described later. Further such a tendency of the temperature distribution with respect to the short direction is true for another place, of the heater 300, such as the surface protecting layer 304 which is the (front) surface of the heater 300.

In FIG. 20, (B) is a graph showing a short direction temperature distribution of the film 202 at the (front) surface in Embodiment 5, Comparison Example Comparison Example 2. The film 202 rotationally moves from the upstream side toward the downstream side and is supplied with heat from the heater 300 by contact with the heater 300 in the inner surface nip NA. For that reason, the (front) surface temperature of the film 202 gradually increases from the upstream side toward the downstream side in the inner surface nip. A degree of this temperature rise depends on the short direction temperature of the heater 300 described above with reference to (A) of FIG. 20. That is, with a higher temperature of the heater 300 in the inner surface nip, the surface temperature of the film 202 more easily increases in the inner surface nip.

As shown in the graph of (B) of FIG. 20, when an upstreammost position of the inner surface nip is x1, a central portion position of the heater 300 is x2, and the downstreammost position of the inner surface is x3, a back surface temperature of the film 202 at each of the positions is as shown in Table 2. Further, in Table 2, as a rise time of the fixing device 200, a time until the (front) surface temperature of the film 202 reaches 225° after the electric power of 1000 W is supplied to the heater 300 in the state of 25° C. which is the room temperature is shown.

TABLE 2

| | x1 (US)*1 | x2 (CT*2) | x3 (DS*3) | RT*4 |
|---|---|---|---|---|
| EMB. 5 | 177° C. | 207° C. | 234° C. | 3.7 sec |
| COMP. EX. 1 | 175° C. | 202° C. | 222° C. | 4.1 sec |
| COMP. EX. 2 | 170° C. | 195° C. | 214° C. | 4.4 sec |

*1"US" is upstream.
*2"CT" is central.
*3"DS" is downstream.
*4"RT" is a rise time.

From Table 2, the surface temperature of the film 202 in Embodiment 5 is highest, and a heat quantity given to the sheet P and the toner is largest, and therefore Embodiment 5 has a constitution in which the rise time of the fixing device 200 can be shortened earliest.

Figure 21:
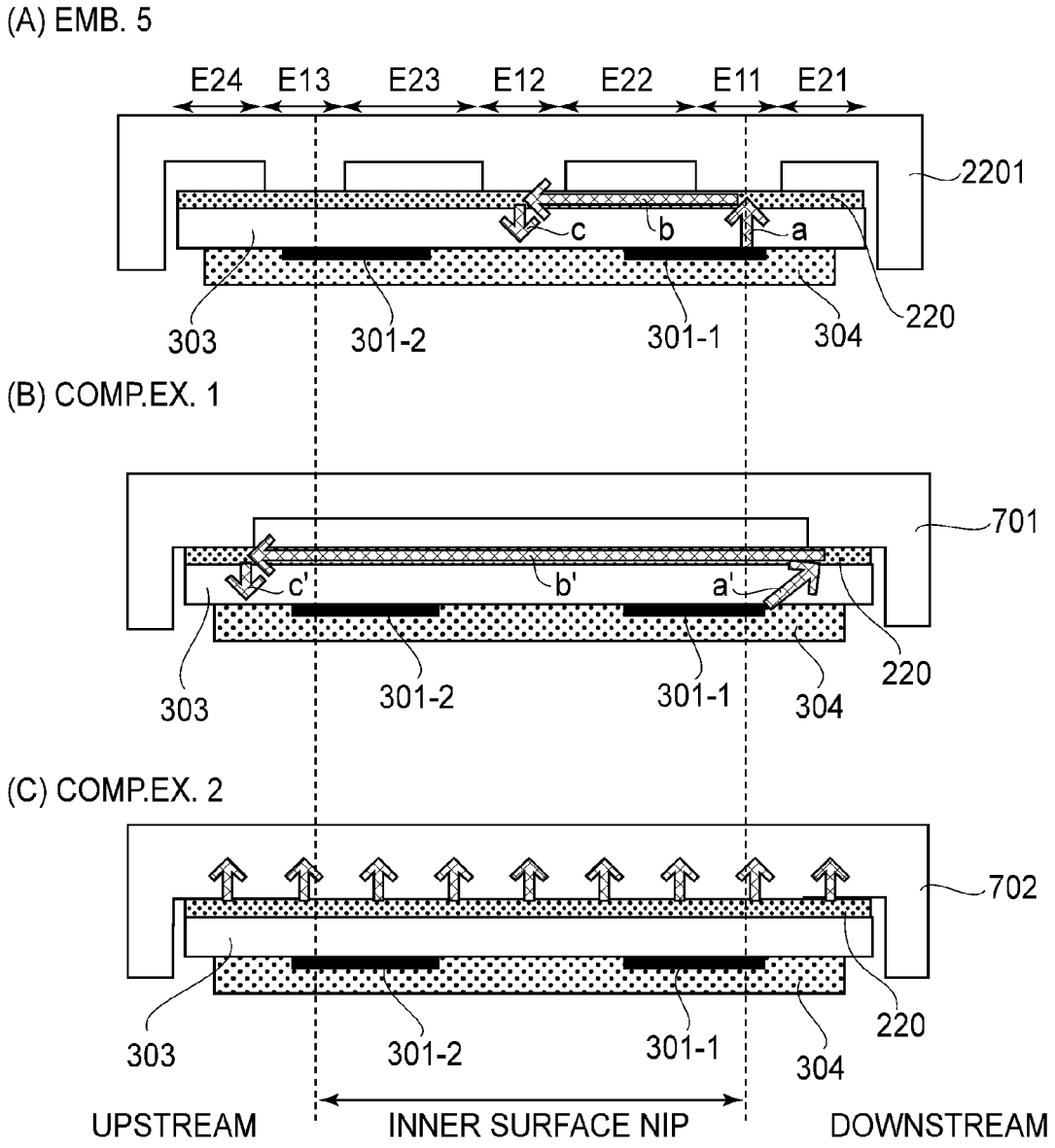
In FIG. 21, (A) to (C) are graphs each showing a flow of heat of the heater, the high heat-conductive member and the heater supporting member.

In FIG. 21, (A), (B) and (C) are schematic sectional views of the heaters 300 in Embodiment 5, Comparison Example 1 and Comparison Example 2, respectively, in which a flow of heat principally delivered by the high heat-conductive member 220 is indicated by arrows.

In Embodiment 5, as shown in (A) of FIG. 21, the heat of the heater 300 moves to the high heat-conductive member 220 in a place of the pressure region 1 (E11) as indicated by an arrow a. This is because the heater 300 has a high temperature in the downstream most side of the inner surface nip as described above with reference to (A) of FIG. 20 and the contact thermal resistance between the high heat-conductive member 220 and the heater 300 in the pressure region 1 (E11) as described above with reference to FIG. 9.

Thereafter, the heat of the arrow a moves to the central portion of the heater 300 via the high heat-conductive member 220 as indicated by arrows b and c. This is because the heater 300 has a lower temperature in the inner surface nip than in another place as described above with reference to (A) of FIG. 20 and the contact thermal resistance between the high heat-conductive member 220 and the heater 300 in the pressure region 2 (E12) as described above with reference to FIG. 9.

Further, in the non-pressure region (E22) which is a region where the heat of the arrow a passes, the contact thermal resistance between the high heat-conductive member 220 and the heater supporting member 2201 is high, and therefore, the heat dissipation into the heater supporting member 2201 is prevented. For that reason, the heat can be further efficiently moved toward the inner surface nip of the heater 300 in the direction X.

In Comparison Example 1, as shown in (B) of FIG. 21, the heat of the heater 300 moves to the high heat-conductive member 220 as indicated by an arrow a'. This is because the heater 300 has a high temperature in the downstream most side of the inner surface nip as described above with reference to (A) of FIG. 20 and the contact thermal resistance between the high heat-conductive member 220 and the heater 300 in the pressure region as described above with reference to FIG. 9.

Thereafter, the heat of the arrow a moves to the upstream side (further upstream of the upstreammost position of the inner surface nip) of the heater 300 via the high heat-conductive member 220 as indicated by arrows b' and c'. In this way, in Comparison Example 1, a movement distance of the heat indicated by the arrow b& is long, and a destination of the movement of the heat indicated by the arrow c' is not the inner surface nip, so that the temperature of the heater 300 at the inner surface nip is lower than in Embodiment 5.

In Comparison Example 2, as shown in (C) of FIG. 21, the amount of heat dissipation from the heater 300 into the heater supporting member 702 via the high heat-conductive member 220 becomes large. For that reason, the temperature of the whole of the heater 300 with respect to the short direction becomes low, so that the rise time of the image heating apparatus 100 becomes long.

As described above, the heater supporting member 2201 in Embodiment 5 has the pressure region 1, where the high heat-conductive member 220 and the heater 300 are pressed against and contacted to each other, in a region including the downstreammost side of the inner surface nip, and has the pressure region 2 at the central portion of the inner surface nip. As a result, the flow of the heat from the downstream side of the heater 300 toward the inner surface nip is created via the high heat-conductive member 220, so that the temperature of the heater 300 at the inner surface nip is raised. Further, places other than the pressure regions 1 to 3 are constituted as the non-pressure regions, so that the heat dissipation into the heater supporting member 2201 is suppressed to facilitate the temperature rise of the heater 300.

In Embodiment 5, by employing the above-described constitution, the inner surface nip temperature of the heater 300 is increased to increase the (front) surface of the film 202, so that the time of the fixing device 200 can be shortened.

(Modified Examples of Heater Supporting Member 2201)

Figure 22:
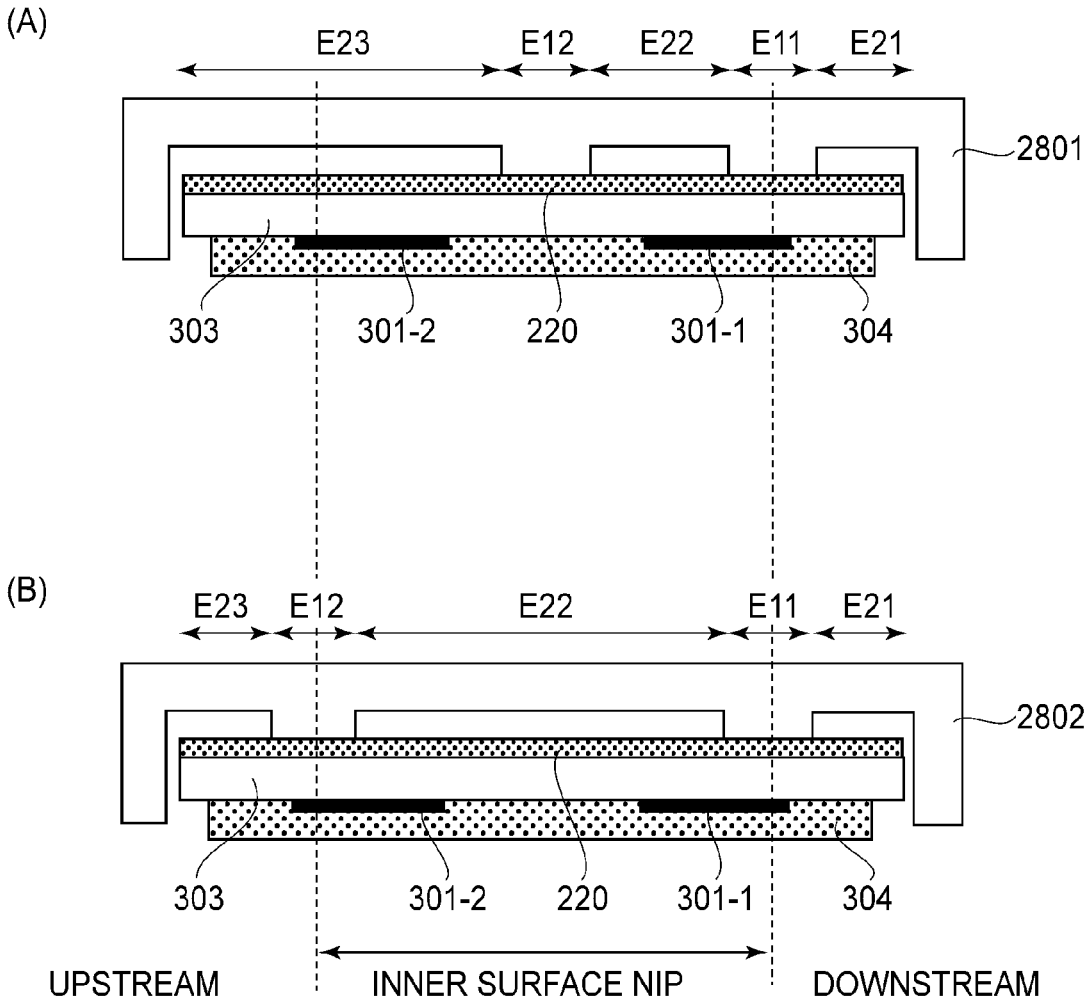
In FIG. 22, (A) and (B) are illustrations each showing a modified example of the heater supporting member in Embodiment 5.

In FIG. 22, (A) and (B) show modified examples of the heater supporting member 2201 in Embodiment 5. Both of a heater supporting member 2801 in (A) of FIG. 22 and a heater supporting member 2802 in (B) of FIG. 22 have constitutions in which the rise time of the fixing device 200 can be shortened than in Comparison Examples 1 and 2. The pressure region 1 where the high heat-conductive member 220 and the heater 300 are pressed against and contacted to each other is provided in the downstreammost side of the inner surface nip, and the pressure region 2 is provided so as to overlap with at least a part of the inner surface nip.

Figure 23:
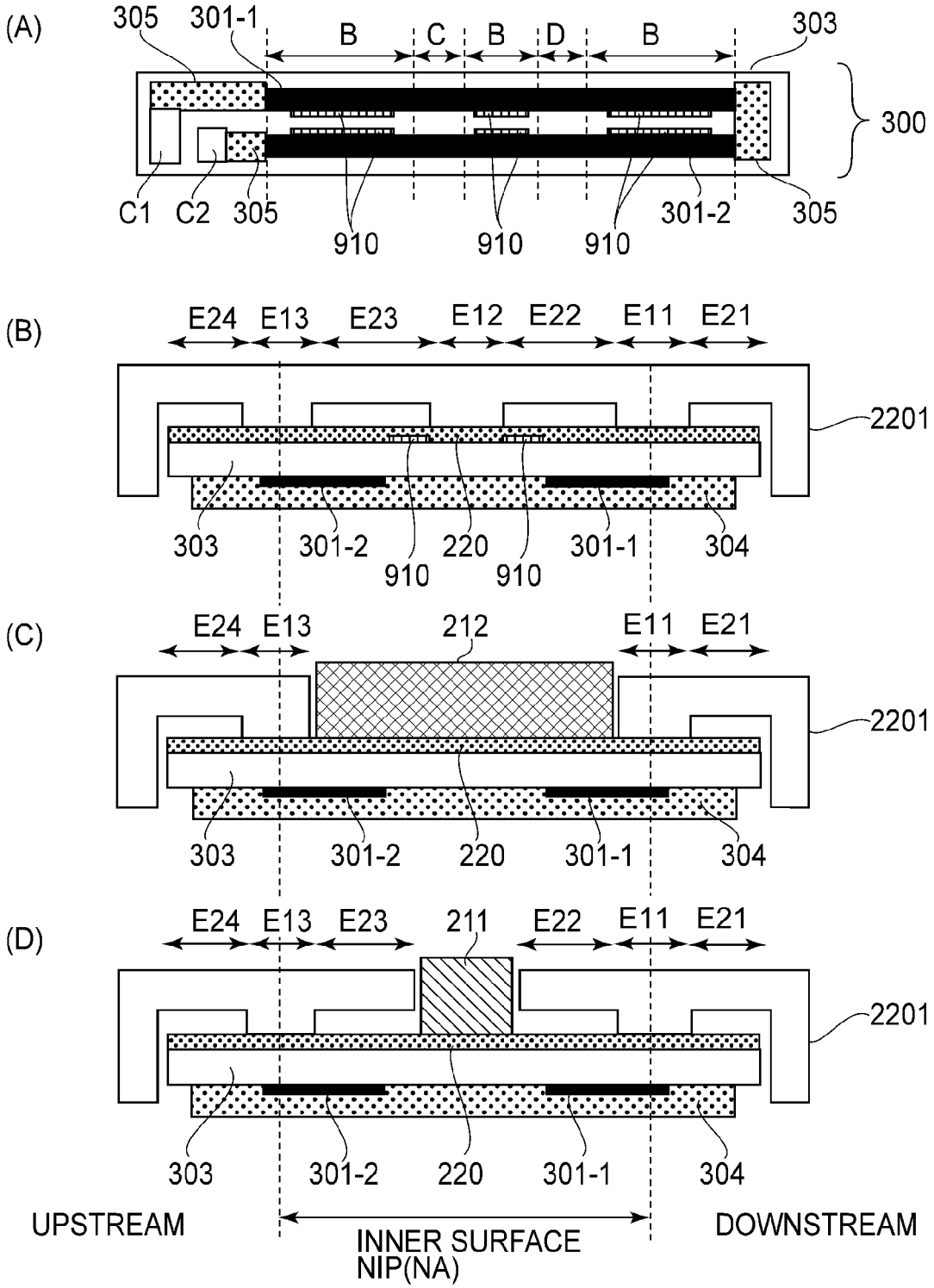
In FIG. 23, (A) to (D) are illustrations in the case where an adhesive is used in Embodiment 5.

In FIG. 23, (A) to (E) are illustrations showing a modified embodiment of Embodiment 5, and show an example of the case where the heater 300 and the high heat-conductive member 220 are bonded to each other by an adhesive 910. This modified embodiment is characterized in that non-pressure regions E22 and E23 where the high heat-conductive member 220 and the heater 300 are not pressed by the heater supporting member 2201 are provided at positions other than the heat generation regions of the heat generating resistors 301-1 and 301-2, and the adhesive material is provided in the non-pressure regions E22 and E23. In other words, the adhesive (material) is provided between the heater and the high heat-conductive member in regions corresponding to the second regions E22 and E23 but is not provided between the heater and the high heat-conductive member in regions corresponding to the first regions E11 and E12. In this way, the adhesive is provided in the non-pressure regions, so that the effect of Embodiment 5 can be obtained also in the case where the adhesive having poor thermal conductivity is used or a stepped portion is formed due to poor elongation of the adhesive.

Embodiment 6

Embodiment 6 in which the heater mounted in the fixing device 200 is changed will be described. Constituent elements similar to those in Embodiment 5 will be omitted from illustration.

Figure 24:
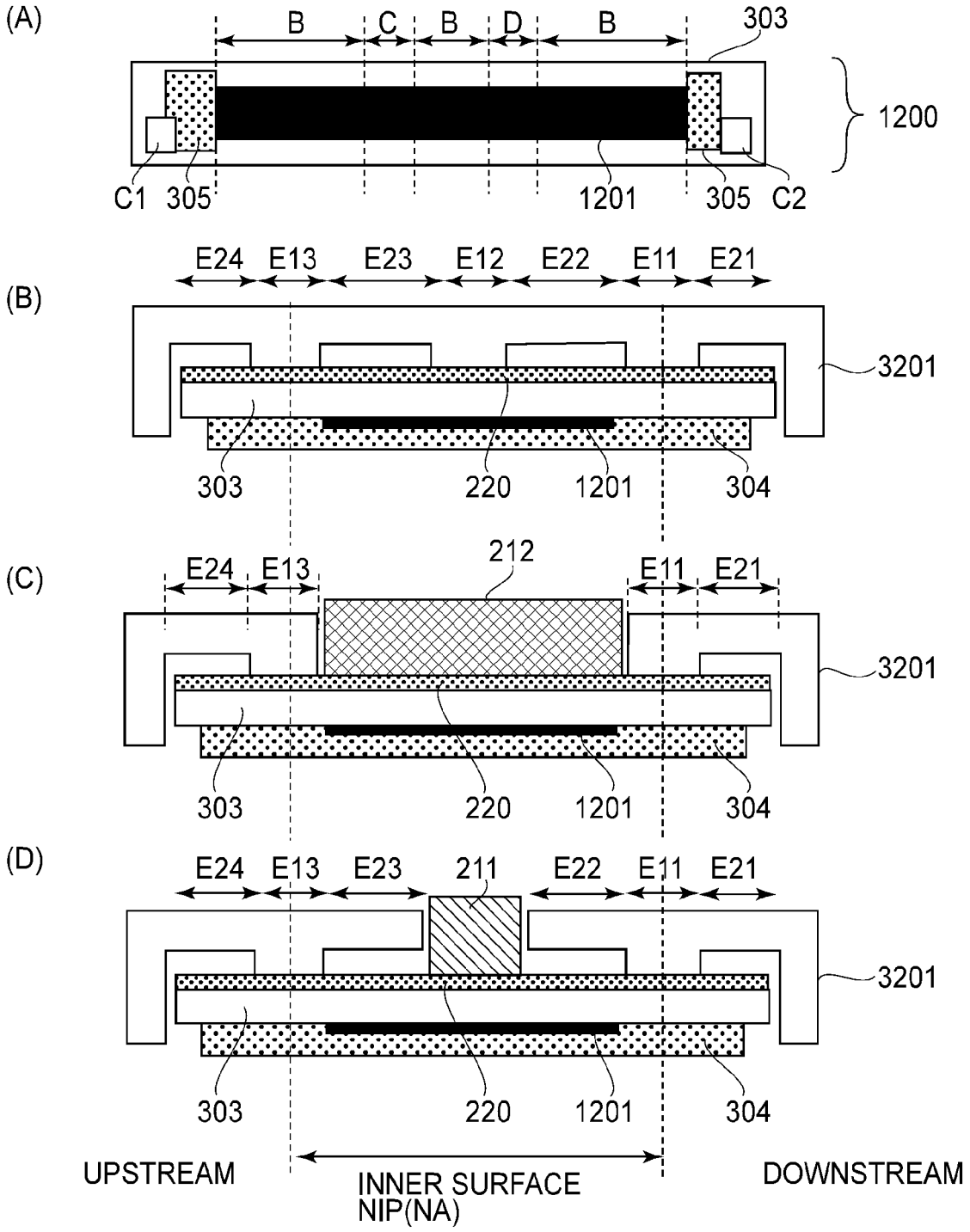
In FIG. 24, (A) to (D) are illustrations of a pressing method of a heater and a high heat-conductive member in Embodiment 6.

In FIG. 24, (A) to (D) are illustrations of a pressing method of a heater 1200 and the high heat-conductive member 220 in Embodiment 6. In (A) of FIG. 24, to a heat generating resistor 1201 provided on the heater 1200 along the longitudinal direction of the heater substrate, the electric power is applied from the electrode portions C1 and C2 via the electroconductive members 305. The heater 1200 in this embodiment includes only a single heat generating resistor 1201.

Next, in this embodiment, where the pressure region positioned in the downstream side should be provided will be described. In this embodiment, a heater supporting member 3201 is used. In Embodiment 5, as described above with reference to FIG. 19, the heat generating resistor exists at the end portion position of the inner surface nip with respect to the direction X. In such a case, as described above with reference to FIG. 20, the back surface temperature of the heater 1200 at the downstreammost portion of the inner surface nip becomes high. For that reason, in Embodiment 5, the pressure region was provided at the downstreammost portion of the inner surface nip.

On the other hand, in this embodiment, as shown in FIG. 24, the downstream end portion position of the inner surface nip is positioned outside the region where the heat generating resistor is provided. Also in such a constitution in Embodiment 6, the rotational speed of the film 202 is 300 mm/sec, and therefore an amount of heat moved to the downstream side is large, so that the back surface temperature of the heater 1200 at the downstreammost portion of the inner surface nip becomes high. For that reason, also in this embodiment, the pressure region may preferably be provided at the downstreammost portion of the inner surface nip similarly as in Embodiment 5. Incidentally, in FIG. 24, (B), (C) and (D) are sectional views of the heater 1200 at positions of B, C and D, respectively, shown in (A) of FIG. 24.

In the cross-section of (B) of FIG. 24, the pressure region 1 (E11) is formed so as to include the downstreammost side of the inner surface nip region, and the pressure region 2 (E12) is formed sufficiently inside the inner surface nip. The pressure region 3 (E13) is disposed so as to be symmetrical with the pressure region 1 (E11) with respect to the short direction center line of the heater 1200 as a reference line. Also in the cross-section of each of (C) and (D) of FIG. 24, the pressure 1 (E11) is formed so as to include the downstreammost side of the inner surface nip region. Further, the pressure region 3 (E13) is disposed s as to be symmetrical with the pressure region 1 (E11) with respect to the short direction center line of the heater 1200 as the reference line.

As shown in this embodiment, the constitution of the present invention is applicable to also the heater 1200 including only the single heat generating resistor 1201.

Embodiment 7

Embodiment 7 in which the heater mounted in the fixing device 200 is changed will be described. Constituent elements similar to those in Embodiment 5 will be omitted from illustration.

Figure 25:
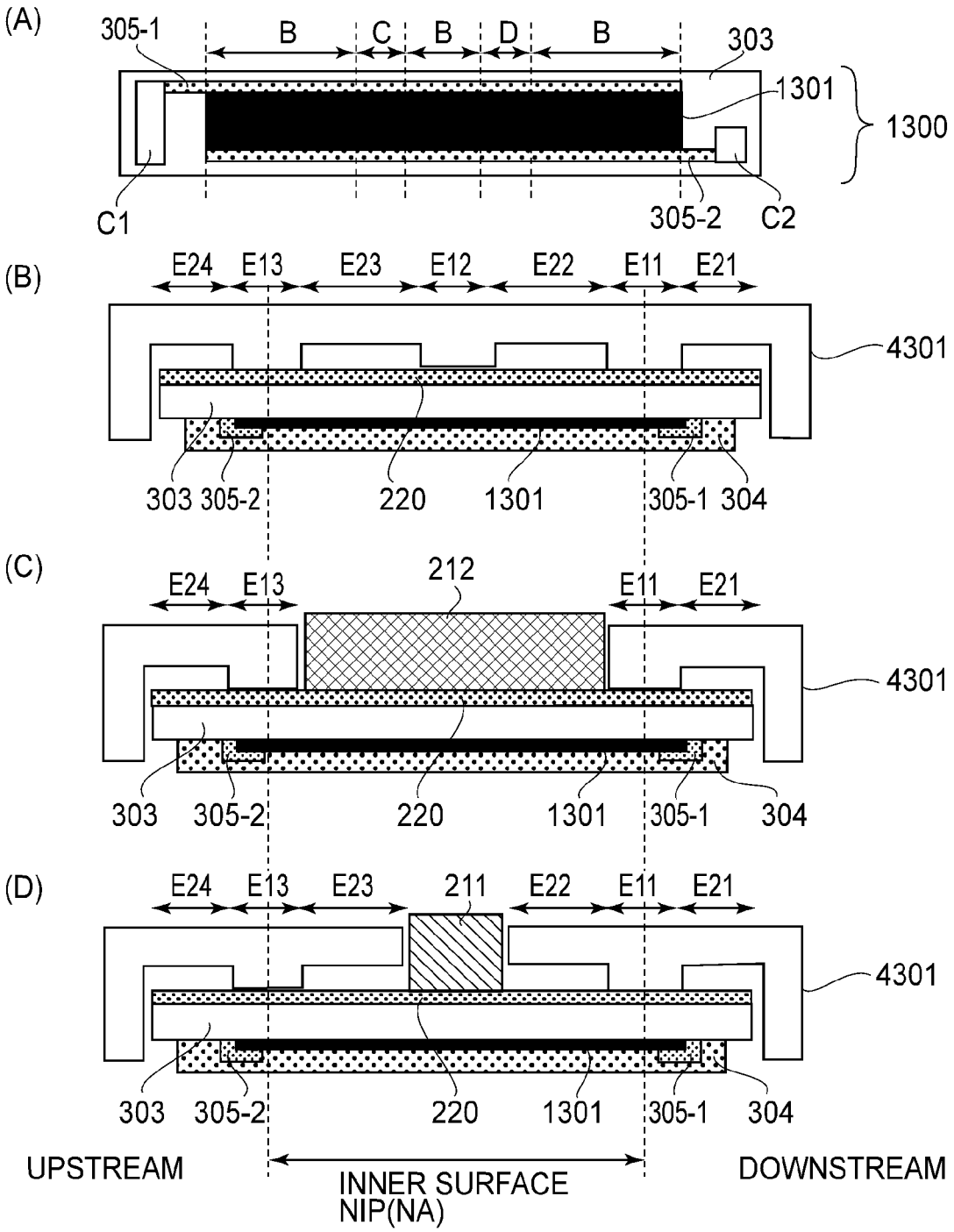
In FIG. 25, (A) to (D) are illustrations of a pressing method of a heater and a high heat-conductive member in Embodiment 7.

In FIG. 25, (A) to (D) are illustrations of a pressing method of a heater 1300 and the high heat-conductive member 220 in Embodiment 7. The constitution of the heater 1300 is the same as in FIG. 17, and therefore will be omitted from illustration. Incidentally, in FIG. 25, (B), (C) and (D) are sectional views of the heater 1300 at positions of B, C and D, respectively, shown in (A) of FIG. 25. In these figures, a heater supporting member 4301 is provided.

In the cross-section of (B) of FIG. 25, the pressure region 1 (E11) is formed so as to include the downstreammost side of the inner surface nip region, and the pressure region 2 (E12) is formed sufficiently inside the inner surface nip. The pressure region 3 (E13) is disposed so as to be symmetrical with the pressure region 1 (E11) with respect to the short direction center line of the heater 1300 as a reference line. Also in the cross-section of each of (C) and (D) of FIG. 25, the pressure 1 (E11) is formed so as to include the downstreammost side of the inner surface nip region. Further, the pressure region 3 (E13) is disposed s as to be symmetrical with the pressure region 1 (E11) with respect to the short direction center line of the heater 1300 as the reference line.

As shown in this embodiment, the constitution of the present invention is applicable to also the heater 1200 in which the electric power is supplied to the 1301 with respect to the recording material feeding direction.

Embodiment 8

Embodiment 8 in which the heater mounted in the fixing device 200 is changed will be described. Constituent elements similar to those in Embodiment 5 will be omitted from illustration.

Figure 26:
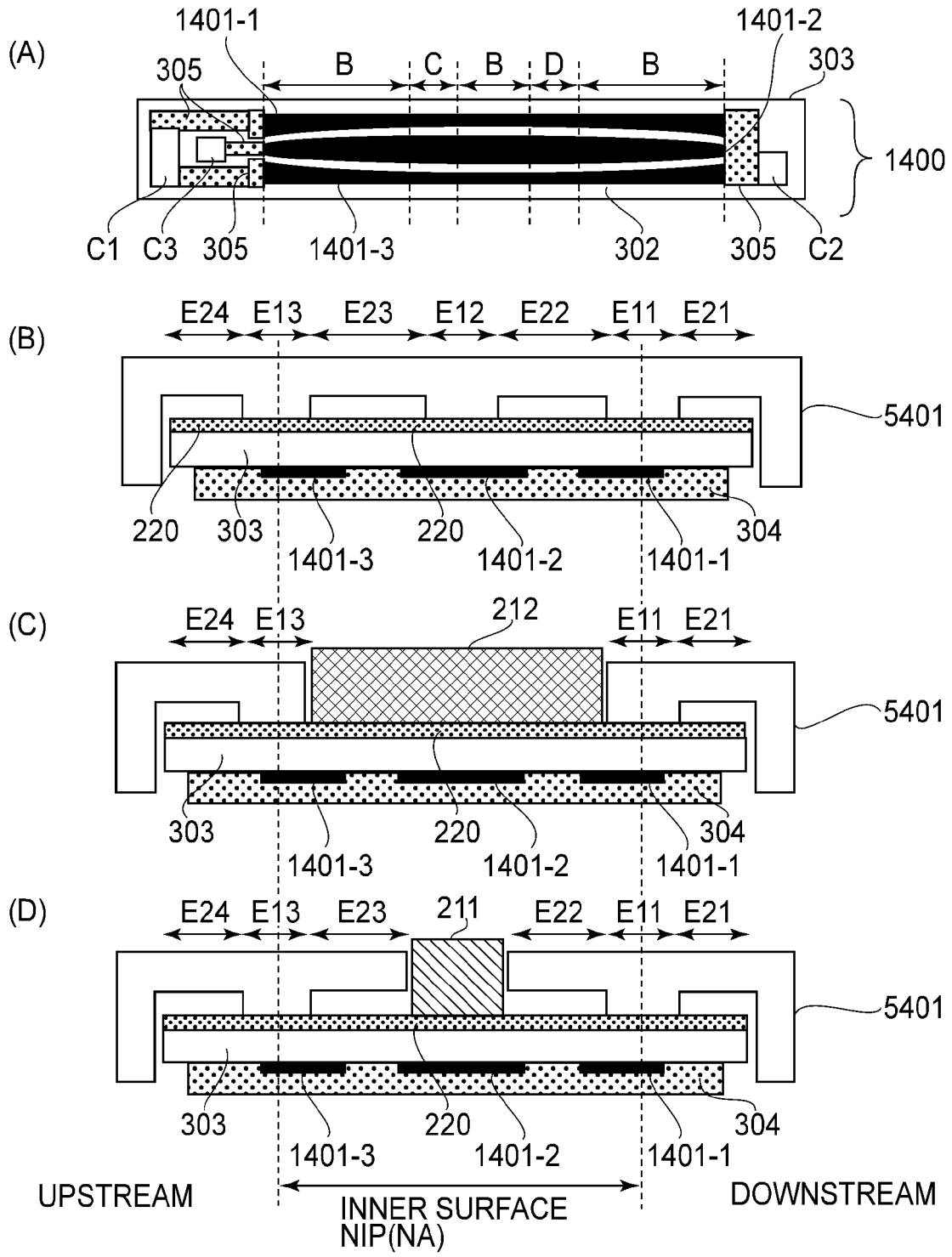
In FIG. 26, (A) to (D) are illustrations of a pressing method of a heater and a high heat-conductive member in Embodiment 8.

In FIG. 26, (A) to (D) are illustrations of a pressing method of a heater 1400 and the high heat-conductive member 220 in Embodiment 8. The constitution of the heater 1400 is the same as in FIG. 18, and therefore will be omitted from illustration. Incidentally, in FIG. 26, (B), (C) and (D) are sectional views of the heater 1400 at positions of B, C and D, respectively, shown in (A) of FIG. 26. In these figures, a heater supporting member 5401 is provided.

In the cross-section of (B) of FIG. 26, the pressure region 1 (E11) is formed so as to include the downstreammost side of the inner surface nip region, and the pressure region 2 (E12) is formed sufficiently inside the inner surface nip. The pressure region 3 (E13) is disposed so as to be symmetrical with the pressure region 1 (E11) with respect to the short direction center line of the heater 1400 as a reference line. Also in the cross-section of each of (C) and (D) of FIG. 26, the pressure 1 (E11) is formed so as to include the downstreammost side of the inner surface nip region. Further, the pressure region 3 (E13) is disposed s as to be symmetrical with the pressure region 1 (E11) with respect to the short direction center line of the heater 1400 as the reference line.

As shown in this embodiment, the constitution of the present invention is applicable to also the heater 1200 including three or more heat generating resistors 1401-1, 1401-2 and 1401-3.

The image heating apparatus in the present invention includes, in addition to the apparatus for heating the unfixed toner image (visualizing agent image, developer image) to fix or temporarily fix the image as a fixed image, an apparatus for heating the fixed toner image again to improve a surface property such as glossiness.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications No. 237909/2013 filed Nov. 18, 2013, 237913/2013 filed Nov. 18, 2013 and 198446/2014 filed Sep. 29, 2014, which are hereby incorporated by reference.

What is claimed is:

1. An image heating apparatus comprising:

a rotatable member;

a heater contacting said rotatable member, said heater including a substrate and a heat generating element provided on the substrate;

a supporting member configured to support said heater; and a heat-conductive member sandwiched between said heater and said supporting member, the heat-conductive member contacting said heater, wherein a recording material on which an image is formed is heated by heat from said heater via said rotatable member, wherein said supporting member has an opposing region opposing said heat-conductive member, said opposing region including a first region where said supporting member contacts said heat-conductive member and a second region where said supporting member is recessed from said heat-conductive member relative to the first region, wherein at least a part of the first region overlaps, with respect to a short direction of said heater, with a region, of said heater, where the heat generating element is provided, when viewed in a longitudinal direction of said heater, and wherein at least a part of the first region overlaps with the second region in the longitudinal direction of said heater, when viewed in the short direction of said heater.

2. An image heating apparatus according to claim 1, wherein at least a part of the second region overlaps with a region, of said heater, outside of the region where said heat generating element is provided, with respect to the short direction, when viewed in the longitudinal direction of said heater.

3. An image heating apparatus according to claim 1, wherein a whole of the first region overlaps with the region of said heater where said heat generating element is provided in the short direction of said heater, when viewed in the longitudinal direction of said heater.

4. An image heating apparatus according to claim 1, wherein a whole of the second region overlaps with the region, of said heater, outside of the region where said heat generating element is provided in the short direction of said heater, when viewed in the longitudinal direction of said heater.

5. An image heating apparatus according to claim 1, wherein with respect to a longitudinal direction of said heater, at an end portion of the opposing region, there is no second region or the second region is narrower than at a central portion.

6. An image heating apparatus according to claim 1, further comprising a temperature detecting element configured to detect the temperature of said heater via said heat-conductive member, wherein said temperature detecting element contacts said heat-conductive member through an opening provided in said supporting member, and wherein the pressure per unit area applied to said heat-conductive member by said temperature detecting element is smaller than the pressure per unit area applied to the first region by said temperature detecting element.

7. An image heating apparatus according to claim 1, further comprising a protecting element actuated by heat from said heater, wherein said protecting element contacts said heat-conductive member through an opening provided in said supporting member, and wherein the pressure per unit area applied to said heat-conductive member by said protecting element is smaller than the pressure per unit area applied to the first region by said protecting element.

8. An image heating apparatus according to claim 1, wherein said heater and said heat-conductive member are bonded with each other by an adhesive, and wherein the adhesive is provided in a region, between said heater and said heat-conductive member, corresponding to the second region, but is not provided in a region, between said heater and said heat-conductive member, corresponding to the first region.

9. An image heating apparatus according to claim 1, wherein said heat-conductive member is a graphite sheet.

10. An image heating apparatus according to claim 1, further comprising a pressing roller contacting said rotatable member and forming a nip portion at which the recording material is conveyed.

11. An image heating apparatus according to claim 10, wherein said rotatable member is a film, and wherein said heater contacts an inner surface of said film and forms the nip portion with said pressing roller via said film.

12. An image heating apparatus according to claim 1, wherein the thermal conductivity of said heat-conductive member with respect to a surface direction thereof is higher than said heater.

13. An image heating apparatus comprising:

a rotatable member;

a heater contacting said rotatable member;

a pressing member contacting said rotatable member and forming a nip portion with said rotatable member;

a supporting member configured to support said heater;

a heat-conductive member sandwiched between said heater and said supporting member, said heat-conductive member contacting said heater, wherein an image formed on a recording material is heated while the recording material is conveyed at the nip portion, wherein said supporting member has an opposing region opposing said heat-conductive member, said heat-conductive member including a first region where said supporting member contacts said heat-conductive member and a second region where said supporting member is recessed from said high heat-conductive member relative to the first region, wherein, with respect to a short direction of said heater, the first region is provided in a region, of the opposing region, where both the furthest upstream portion of said heat-conductive member and the furthest downstream portion of said heat-conducive member oppose, and wherein the second region is provided between the furthest upstream portion of said heat-conductive member and the furthest downstream portion of said heat-conductive member in the short direction of said heater, and wherein at least a part of the first region overlaps with the second region in a longitudinal direction of said heater, when viewed in the short direction of said heater.

14. An image heating apparatus according to claim 13, wherein said heater includes a substrate and a heat generating element formed on the substrate, and wherein, with respect to the short direction of said heater, at least a part of the first region overlaps with the region, of said heater, where said heat generating element is provided, when viewed in the longitudinal direction of said heater.

15. An image heating apparatus according to claim 13, wherein said heater includes a substrate and a heat generating element formed on the substrate, and wherein at least the part of the second region overlaps with a region, of said heater, outside of the region where said heat generating element is provided, with respect to the short direction of said heater, when viewed in the longitudinal direction of said heater.

16. An image heating apparatus according to claim 13, wherein said heater and said heat-conductive member are bonded with each other by an adhesive, and wherein the adhesive is provided in a region, between said heater and said heat-conductive member, corresponding to the second region, but is not provided in a region, between said heater and said heat-conductive member, corresponding to the first region.

17. An image heating apparatus according to claim 13, wherein said heat-conductive member is a graphite sheet.

18. An image heating apparatus according to claim 13, wherein the thermal conductivity of said heat-conductive member with respect to a surface direction thereof is higher than said heater.

19. An image heating apparatus according to claim 13, wherein the width of said heat-conductive member in the conveyance direction is narrower than the width of said heater in the conveyance direction.

20. An image heating apparatus comprising:

a rotatable member;

a heater contacting said rotatable member, said heater including a substrate and a heat generating element provided on the substrate;

a supporting member configured to support said heater;

a heat-conductive member sandwiched between said heater and said supporting member, the heat-conductive member contacting said heater, wherein a recording material on which an image is formed is heated by heat from said heater via said rotatable member, wherein said supporting member has an opposing region opposing said heat-conductive member, said opposing region including a first region where said supporting member contacts said heat-conductive member and a second region which is recessed more than the first region, wherein at least a part of the first region overlaps, with respect to a short direction of said heater, with a region, of said heater, where the heat generating element is provided, when viewed in the longitudinal direction of said heater, and wherein at least a part of the first region overlaps with the second region in the longitudinal direction, when viewed in the short direction of said heater.

21. An image heating apparatus according to claim 11, a surface of said heat-conductive member, where the opposing region of said supporting member opposes, is a flat surface.

* * * * *